US008550827B1

(12) United States Patent
Sandoval et al.

(10) Patent No.: US 8,550,827 B1
(45) Date of Patent: Oct. 8, 2013

(54) MULTI-SLEEVE POWER TIPS

(75) Inventors: Arthur G. Sandoval, San Francisco, CA (US); Wenson Chern, Mountain View, CA (US); Guangqun Max Chen, San Francisco, CA (US)

(73) Assignee: Targus Group International, Inc., Anaheim, CA (US)

( * ) Notice: Subject to any disclaimer, the term of this patent is extended or adjusted under 35 U.S.C. 154(b) by 0 days.

(21) Appl. No.: 13/557,976

(22) Filed: Jul. 25, 2012

(51) Int. Cl.
*H01R 13/44* (2006.01)

(52) U.S. Cl.
USPC ..... 439/131

(58) Field of Classification Search
USPC ..... 439/131
See application file for complete search history.

(56) References Cited

U.S. PATENT DOCUMENTS

| | | | | |
|---|---|---|---|---|
| 4,543,624 | A * | 9/1985 | Rumble | 363/146 |
| 4,626,052 | A * | 12/1986 | Rumble | 439/173 |
| 5,347,211 | A | 9/1994 | Jakubowski | |
| 5,479,331 | A | 12/1995 | Lenni | |
| 5,547,399 | A | 8/1996 | Naghi et al. | |
| 5,636,110 | A | 6/1997 | Lanni | |
| 5,838,554 | A | 11/1998 | Lanni | |
| 5,949,213 | A | 9/1999 | Lanni | |
| 6,035,187 | A | 3/2000 | Franza | |
| 6,038,127 | A | 3/2000 | Ries | |
| 6,064,177 | A | 5/2000 | Dixon | |
| 6,091,611 | A | 7/2000 | Lanni | |
| 6,137,280 | A | 10/2000 | Ackermann et al. | |
| 6,172,884 | B1 | 1/2001 | Lanni | |
| 6,191,552 | B1 | 2/2001 | Kates et al. | |
| 6,212,088 | B1 | 4/2001 | Yoo | |
| 6,266,261 | B1 | 7/2001 | Lanni | |
| 6,433,274 | B1 | 8/2002 | Doss et al. | |
| 6,459,604 | B1 | 10/2002 | Youn et al. | |
| 6,538,341 | B1 | 3/2003 | Lang | |
| D473,848 | S | 4/2003 | Zheng et al. | |
| 6,643,158 | B2 | 11/2003 | McDonald et al. | |

(Continued)

FOREIGN PATENT DOCUMENTS

| | | |
|---|---|---|
| CA | 2 403 856 | 10/2001 |
| EP | 1 603 218 A2 | 12/2005 |

(Continued)

OTHER PUBLICATIONS

International Search Report for PCT/US05/35242 filed Sep. 30, 2005, and mailed Jul. 21, 2008, 5 pgs.

(Continued)

*Primary Examiner* — James Harvey
(74) *Attorney, Agent, or Firm* — John R. Thompson; Stoel Rives LLP

(57) ABSTRACT

Consolidated power tips allow a power adaptor to be connected to disparately sized input ports of electronic devices. The consolidated power tips may be sized to balance insertion and pull-out forces for the disparately sized input ports. Deformable members may be added to the consolidated power tips for more desirable insertion and pull-out forces and improved electrical contact. The consolidated power tips may be combined into a multi-sleeve power tip. Each sleeve comprises a device interface for a different set of input ports. Unused sleeves may be retracted into the housing of the power tip. Manual or automatic extension mechanisms may be provided for extending the device interfaces from the housing. The multi-sleeve power tip allows users to interface with a large number of disparate devices without changing power tips.

29 Claims, 23 Drawing Sheets

(56) References Cited

U.S. PATENT DOCUMENTS

| | | | | |
|---|---|---|---|---|
| 6,650,560 | B2 | 11/2003 | MacDonald et al. | |
| 6,664,758 | B2 | 12/2003 | Yang | |
| 6,693,413 | B1 | 2/2004 | Lanni | |
| 6,700,808 | B2 | 3/2004 | MacDonald et al. | |
| 6,707,284 | B2 | 3/2004 | Lanni | |
| 6,751,109 | B2 | 6/2004 | Doss et al. | |
| 6,765,365 | B2 | 7/2004 | Kim et al. | |
| 6,775,163 | B2 | 8/2004 | McDonald et al. | |
| 6,791,853 | B2 | 9/2004 | Afzal et al. | |
| 6,805,579 | B2 | 10/2004 | Marchand et al. | |
| 6,809,943 | B2 | 10/2004 | Lanni | |
| 6,831,848 | B2 | 12/2004 | Lanni | |
| 6,836,101 | B2 | 12/2004 | Lanni | |
| 6,850,423 | B2 | 2/2005 | Lanni | |
| 6,903,950 | B2 | 6/2005 | Afzal et al. | |
| 6,920,056 | B2 | 7/2005 | MacDonald et al. | |
| 6,922,347 | B2 | 7/2005 | Lanni | |
| 6,934,561 | B2 | 8/2005 | Burrus, IV | |
| 6,937,490 | B2 | 8/2005 | MacDonald et al. | |
| 6,939,150 | B1 | 9/2005 | Lanni | |
| 6,976,885 | B2 | 12/2005 | Lord | |
| 7,035,126 | B1 | 4/2006 | Lanni | |
| 7,041,400 | B2 | 5/2006 | Kim et al. | |
| 7,056,149 | B1 | 6/2006 | Lanni | |
| 7,072,200 | B2 | 7/2006 | Lanni | |
| 7,139,181 | B2 | 11/2006 | Afzal et al. | |
| 7,140,921 | B2 | 11/2006 | Liu | |
| 7,142,423 | B2 | 11/2006 | Lanni | |
| 7,145,312 | B2 | 12/2006 | Lanni | |
| 7,145,787 | B2 | 12/2006 | Lanni | |
| 7,148,659 | B2 | 12/2006 | Lanni | |
| 7,153,169 | B2 | 12/2006 | Lord | |
| 7,193,398 | B2 | 3/2007 | Lanni | |
| 7,193,873 | B2 | 3/2007 | Lanni | |
| 7,224,086 | B2 | 5/2007 | Germagian et al. | |
| 7,254,048 | B2 | 8/2007 | Lanni | |
| 7,265,973 | B2 | 9/2007 | Lanni | |
| 7,266,003 | B2 | 9/2007 | Lanni | |
| 7,273,384 | B1 | 9/2007 | So | |
| 7,279,868 | B2 | 10/2007 | Lanni | |
| 7,352,158 | B2 | 4/2008 | Remson | |
| 7,355,851 | B2 | 4/2008 | Lanni | |
| 7,365,524 | B2 | 4/2008 | Lanni | |
| 7,365,973 | B2 | 4/2008 | Rasmussen et al. | |
| 7,377,805 | B2 | 5/2008 | Kim et al. | |
| 7,388,305 | B2 | 6/2008 | McCoy et al. | |
| 7,420,823 | B2 | 9/2008 | Lanni | |
| 7,450,390 | B2 | 11/2008 | Lanni | |
| 7,450,403 | B2 | 11/2008 | Lanni | |
| 7,453,171 | B2 | 11/2008 | Lanni | |
| 7,456,714 | B2 | 11/2008 | McCoy et al. | |
| 7,460,381 | B2 | 12/2008 | Lanni | |
| 7,489,116 | B2 | 2/2009 | Lanni | |
| 7,495,941 | B2 | 2/2009 | Lanni | |
| 7,502,233 | B2 | 3/2009 | Kim et al. | |
| 7,545,656 | B2 | 6/2009 | Lanni | |
| 7,597,570 | B2 | 10/2009 | So | |
| 7,613,021 | B2 | 11/2009 | Lanni | |
| 7,642,671 | B2 | 1/2010 | Mahaffey | |
| 7,646,107 | B2 * | 1/2010 | Smith | 307/11 |
| 7,649,279 | B2 | 1/2010 | Lanni | |
| 7,727,005 | B2 | 6/2010 | Lanni | |
| 8,113,855 | B2 * | 2/2012 | Green et al. | 439/131 |
| 8,460,017 | B1 * | 6/2013 | Green et al. | 439/131 |
| 2003/0042881 | A1 | 3/2003 | Lanni | |
| 2003/0119442 | A1 | 6/2003 | Kwak et al. | |
| 2003/0128020 | A1 | 7/2003 | Lanni | |
| 2003/0132668 | A1 | 7/2003 | Lanni | |
| 2003/0228792 | A1 | 12/2003 | Lanni | |
| 2004/0108833 | A1 | 6/2004 | Lanni | |
| 2004/0130304 | A1 | 7/2004 | Lanni | |
| 2004/0203897 | A1 | 10/2004 | Rogers | |
| 2004/0240236 | A1 | 12/2004 | Lanni | |
| 2004/0257835 | A1 | 12/2004 | Lanni | |
| 2005/0021870 | A1 | 1/2005 | Carnahan et al. | |
| 2005/0024907 | A1 | 2/2005 | Lanni | |
| 2005/0117376 | A1 | 6/2005 | Wilson | |
| 2005/0141252 | A1 | 6/2005 | Mollo | |
| 2005/0162020 | A1 | 7/2005 | Lanni | |
| 2005/0201124 | A1 | 9/2005 | Lanni | |
| 2005/0266730 | A1 | 12/2005 | Lanni | |
| 2006/0007715 | A1 | 1/2006 | MacDonald et al. | |
| 2006/0020557 | A1 | 1/2006 | Nixon | |
| 2006/0105619 | A1 | 5/2006 | Lanni | |
| 2006/0183381 | A1 | 8/2006 | Lanni | |
| 2006/0187696 | A1 | 8/2006 | Lanni | |
| 2006/0202557 | A1 | 9/2006 | Menas et al. | |
| 2006/0215381 | A1 | 9/2006 | Lanni | |
| 2006/0227580 | A1 | 10/2006 | Lanni | |
| 2006/0250829 | A1 | 11/2006 | Lanni | |
| 2006/0250830 | A1 | 11/2006 | Lanni | |
| 2006/0256595 | A1 | 11/2006 | Lanni | |
| 2006/0279139 | A1 | 12/2006 | Stefancscu | |
| 2006/0279928 | A1 | 12/2006 | Lanni | |
| 2007/0035287 | A1 | 2/2007 | DuBose et al. | |
| 2007/0055791 | A1 | 3/2007 | Wood et al. | |
| 2007/0073420 | A1 | 3/2007 | Lanni | |
| 2007/0099519 | A1 | 5/2007 | Lord | |
| 2007/0171593 | A1 | 7/2007 | DuBose | |
| 2007/0175655 | A1 | 8/2007 | Swanson et al. | |
| 2007/0182388 | A1 | 8/2007 | Lanni | |
| 2007/0279952 | A1 | 12/2007 | Lanni | |
| 2007/0296380 | A1 | 12/2007 | Lanni | |
| 2007/0297134 | A1 | 12/2007 | Lanni | |
| 2008/0007212 | A1 | 1/2008 | Theytaz et al. | |
| 2008/0012425 | A1 | 1/2008 | Lanni | |
| 2008/0012427 | A1 | 1/2008 | Wilson et al. | |
| 2008/0019154 | A1 | 1/2008 | Lanni | |
| 2008/0019156 | A1 | 1/2008 | Lanni | |
| 2008/0151581 | A1 | 6/2008 | Lanni | |
| 2008/0164764 | A1 | 7/2008 | So | |
| 2008/0231233 | A1 | 9/2008 | Thornton | |
| 2009/0021189 | A1 | 1/2009 | DuBose et al. | |
| 2009/0096565 | A1 | 4/2009 | Lanni | |
| 2009/0197457 | A1 | 8/2009 | Lanni | |
| 2010/0058409 | A1 | 3/2010 | Chapman et al. | |
| 2010/0109436 | A1 | 5/2010 | Lanni | |
| 2010/0190384 | A1 | 7/2010 | Lanni | |
| 2010/0254162 | A1 | 10/2010 | Lanni | |
| 2010/0283330 | A1 | 11/2010 | Lanni | |

FOREIGN PATENT DOCUMENTS

| | | | |
|---|---|---|---|
| EP | 1 811 614 | A2 | 7/2007 |
| EP | 1 372 254 | B1 | 7/2008 |
| EP | 1 575 152 | B1 | 4/2009 |
| EP | 1 273 093 | B1 | 7/2009 |
| WO | WO 01/76051 | A2 | 10/2001 |
| WO | WO 03/038980 | A1 | 5/2003 |
| WO | WO 2004/082110 | | 9/2004 |
| WO | WO 2005/015721 | A1 | 2/2005 |
| WO | WO 2008/008209 | A2 | 1/2008 |

OTHER PUBLICATIONS

Written Opinion of the International Search Authority for PCT/US05/35242 filed Sep. 30, 2005, and mailed Jul. 21, 2008, 9 pgs.

* cited by examiner

MULTI-SLEEVE POWER TIPS

TECHNICAL FIELD

This disclosure relates to power tips for power adaptors.

DETAILED DESCRIPTION OF PREFERRED EMBODIMENTS

Figure 1A:
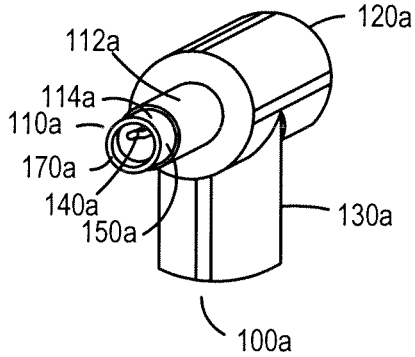
FIGS. 1A-C are front angled views of consolidated power tips.

Consumer electronics and other electronic devices often need electrical power to power the device and/or charge one or more batteries. These electronic devices may include computers, laptops, tablets, mobile telephones, smart phones, personal digital assistants ("PDAs"), personal media players, and the like. Electronic devices require that electrical power comply with electrical requirements of the device. Electronic devices may require that the electrical power be supplied as direct current ("DC"), that a voltage between the terminals is within one or more predetermined ranges, and a certain current level be supplied. Because most power sources, such as household outlets, automobile and other vehicle outlets, and the like, are alternating current ("AC") or are at a voltage outside the predetermined range, a power adaptor is needed to convert electricity from the power source such that it complies with the electrical requirements of the electronic device.

If the electronic device receives electrical power that does not comply with the electrical requirements, it may damage the electronic device. Electronic devices have physically distinct electrical input ports to prevent a potentially damaging connection with a power source not meeting the electronic devices' electrical requirements. Conventional power adaptors are generally designed to satisfy the electrical requirements of a single electronic device. These power adaptors are only designed to interface with the electrical input port for that particular electronic device.

Instead, a programmable power adaptor may be programmed to adapt to the electrical requirements of a plurality of electrical devices. This may involve manual selection by a user or an automatic determination of the electrical requirements. Alternatively, a power adaptor may be designed to output electrical power at a voltage and current that meets the requirements of the electrical requirements of multiple electronic devices. Such universal power adaptors should also be able to physically interface with input ports of the electronic devices. The power adaptors may have an intermediate output connector that interfaces with variably sized power tips. Each power tip is designed to physically and electrically couple with an input port of an electronic device through a device interface and to physically and electrically couple with the intermediate output connector through an adaptor interface. Input ports and device interfaces may be various shapes, including, but not limited to, cylindrical, rectangular, trapezoidal, or the like. The power tips are further designed to electrically couple the input port with the power adapter via the intermediate output connector. In some embodiments, the programmable power adaptor may automatically determine the electrical requirements of the input port based on the power tip connected to it.

Because of the large variety of input ports for electrical devices, universal power adaptors may come with large numbers of disparate power tips. This requires power adaptor manufacturers to design and manufacture the large number of disparate power tips, which can make the manufacturing process less efficient. Additionally, consumers may purchase power tips they do not need, which can lead to waste and extra expense for the consumer. These problems may be alleviated by designing power tips that are able to interface with multiple variably sized input ports.

Power tips are designed to be held in place by a frictional force between the power tip and the input port. The frictional force arises from contact between surfaces of the device interface and surfaces of the input port. The frictional force depends on the materials of the power tip and input port and the normal force between the power tip and input port. The normal force depends on the size and shape of the power tip and input port. As the elements of the power tip and input port contact and attempt to occupy the same space, those elements will be deformed and will exert a force resisting deformation, a component of which will be the normal force. The size and shape of the power tip controls the extent that the input port and power tip attempt to occupy the same space, and accordingly, the deformation resisting force.

The frictional force results in the power tips having an insertion resistance and a pull resistance. A user will need to apply an insertion force sufficient to overcome the insertion resistance to insert the power tip into the input port of the electrical device. If the insertion resistance is too high, it will be difficult for users to insert the power tip into the electronic device. A user will need to apply a pull-out force sufficient to overcome the pull resistance to remove the power tip from the electronic device. If the pull resistance is too low, the power tip may dislodge from the input port when a user does not desire it to do so. Accordingly, improper insertion and pull resistances can have a large, negative impact on the experience of a user.

The insertion resistance and pull resistance for a power tip can be modified by changing sizes and shapes of the elements of the power tip during design to increase or reduce the normal and frictional forces. Because the insertion resistance is often correlated to the pull resistance, power tips may be designed to appropriately balance the insertion resistance and the pull resistance. An acceptable insertion resistance may be no more than a threshold, such as 2, 3, 4, 5, 6, 7, 8, 9, or 10 lbs. Above this threshold, the power tip may be unusable due to an inability to insert the power tip and/or may create strong negative reactions from some users. An acceptable pull resistance may be no less than a threshold, such as 0.5, 1, 1.5, 2, 2.5, 3, 3.5, or 4 lbs. Below this threshold, the power tip may become dislodged frequently enough to annoy users or substantially interfere with powering the electronic device. Instead of using thresholds, the power tip may be designed to come as close as possible to a target insertion resistance and/or a target pull resistance.

Consolidated Power Tips

Figure 1B:
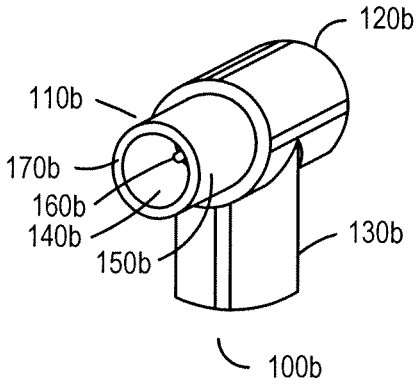
Figure 1C:
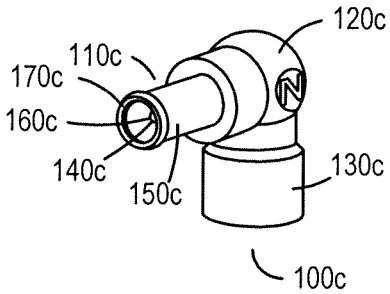

FIGS. 1A-C are angled front views of consolidated power tips for many common input ports. Each power tip 100*a-c* in the illustrated embodiments has a device interface 110*a-c* comprising at least two electrical contacts 140*a-c*, 150*a-c* to interface with the input port of the electronic device. The device interface 110*a-c* may comprise a cylinder with at least one of the electrical contacts disposed there on. The device interface 110*a-c* extends from a housing 120*a-c* that protects wires (not shown) and their connections to the electrical contacts 140*a-c*, 150*a-c* from damage. The housing 120*a-c* may be plastic, rubber, or the like. An insulating section 170*a-c* may prevent the electrical contacts 140*a-c*, 150*a-c* from directly electrically coupling with each other, which might create a short circuit. A base 130*a-c* of the housing 120*a-c* is designed to interface with the intermediate output connector of a power supply (not shown). The bottom of the base 130*a-c* comprises an adaptor interface with electrically conductive pins or other electrically conductive contacts. The intermediate output connector can be removably coupled with the adaptor interface. Some embodiments may have a center pin 160*b-c*, which can have a voltage rail 140*c* disposed on its surface.

A first consolidated power tip 100*a* may comprise a device interface 110*a* comprising a cylinder. A first electrical contact 140*a* may be disposed on an inner surface of the cylinder, and a second electrical contact 150*a* may be disposed on an outer surface of the cylinder. The first electrical contact 140*a* may be electrically conductive material on the inner surface of the cylinder, or as illustrated, one or more arched strips of conductive material may run longitudinally along the inner surface of the cylinder. Similarly, the second electrical contact 150*a* may be conductive material on the outer surface of the cylinder, or some or all of the cylinder may be made from an electrically conductive material. The cylinder may further comprise the insulating section 170*a* that prevents direct electrical coupling of the electrical contacts 140*a*, 150*a*. The cylinder may also comprise differently sized sections. In the illustrated embodiment, a first cylindrical section 112*a* is disposed proximally to the housing 120*a* and a second cylindrical section 114*a* is disposed distally from the housing 120*a*. An outer circumference of the first cylindrical section 112*a* is larger than an outer circumference of the second cylindrical section 114*a*, but inner circumferences of each cylindrical section 112*a*, 114*a* are equal. Depending on the input ports the consolidated tip is designed to fit, the cylinder may comprise additional section, the inner circumferences may vary between sections, or outer circumferences may be sized differently.

Figure 2A:
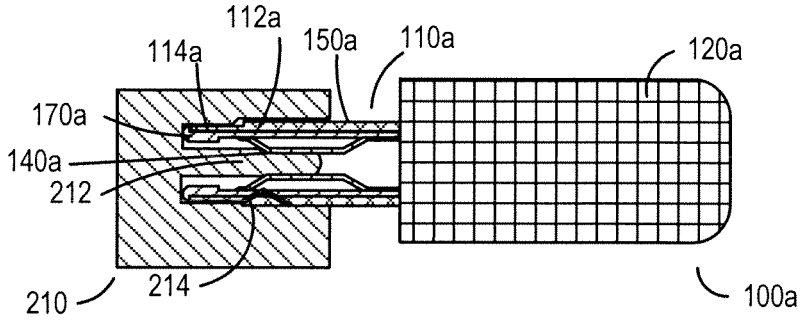
FIGS. 2A-F are cross-section views of the consolidated power tips interfacing with input ports of varying sizes.
Figure 2B:
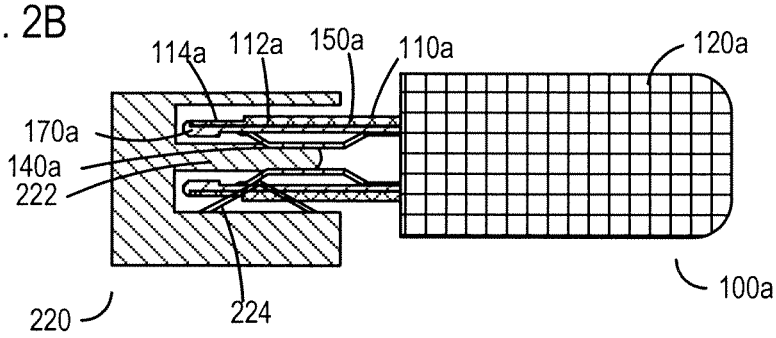
Figure 2C:
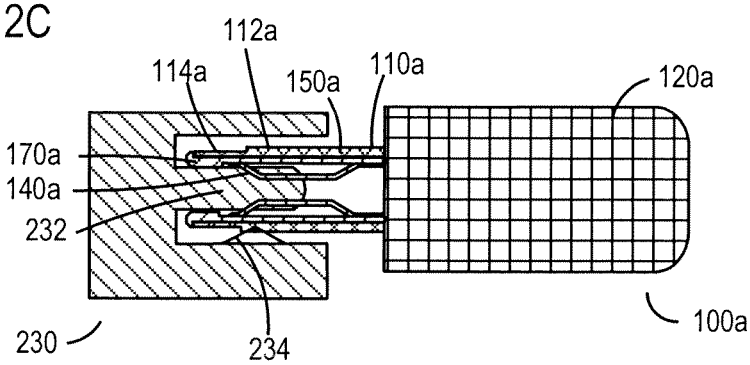

FIGS. 2A-C are cross-section views of the first consolidated tip 100*a* interfacing with input ports 210, 220, 230 of varying sizes and design. Each illustrated input port 210, 220, 230 comprises a cylindrical void into which the device interface 110*a* may be inserted. Each input port 210, 220, 230 also comprises a pin 212, 222, 232 that electrically couples with the first electrical contact 140*a*. The arch shape allows the first electrical contact 140*a* to electrically couple with the smaller pin 212 of the first input port 210, but it flexes to still allow insertion of the larger pin 232 of the third input port 230, without too large of an insertion resistance. The input ports 210, 220, 230 may comprise electrical contacts 214, 224, 234 on the surface surrounding the cylindrical void. The second electrical contact 150*a* of the power tip 100*a* may electrically couple with these electrical contacts 214, 224, 234.

The consolidated power tip 100*a* is designed to ensure electrical coupling with each desired input port 210, 220, 230 while maintaining acceptable insertion and pull resistances. Design variables include: the outer and inner circumferences of the cylinder; the number of arched strips, the length of the arched strips, the height of the arched strips from the cylinder, and the rigidity of the arched strips; and other variations of the size and shape of the device interface 110*a*. The size and shape may be selected by choosing target insertion and/or pull-out resistances and minimizing the deviation of resistances for input ports 210, 220, 230 of interest from the target resistance values. Minimizing deviation may comprise minimizing the maximum deviation of any resistance from the target resistance values; minimizing the average deviation of all resistances from the target resistance values; or the like. Alternatively, the size and shape may be selected to ensure that the insertion resistance for each input port is below a predetermined threshold and the pull resistance for each input port is above a predetermined threshold. Different aspects of the size and shape may be altered to ensure that the interaction with each input port is within the predetermined thresholds.

In the illustrated embodiment, the outer circumference of the device interface 110*a* is large enough to frictionally engage with the outer walls of the cylindrical void of input port 210. This provides a pull resistance for input port 210 above a desired threshold, while contributing little to the insertion resistance of input ports 220 and 230. The arched strips and inner circumference are selected to balance the pull resistance of input port 220 with the insertion resistance of input port 230. The inner circumference is large enough to interface with the largest pin 232 without the insertion resistance exceeding the desired threshold. Yet, it still provides an adequate pull resistance for the input port 230. Additionally, the arched strips are deformable, so the largest pin 232 still fits in the device interface 110*a* even though it is wider than the space between the arched strips. For input port 220, the arched strips are sufficiently arched and rigid to engage frictionally with the pin 222 and provide pull resistance above the desired threshold. The large electrical contact 224 of the input port 220 can also contribute to the pull resistance. The device interface 110*a* is thus able to maintain acceptable insertion and pull resistances across a plurality of input ports 210, 220, 230.

A second consolidated power tip 100*b* may also comprise a device interface 110*b* comprising a cylinder. A first electrical contact 140*b* may again be disposed on an inner surface of the cylinder, and a electrical contact 150*b* may again be disposed on the outer surface of the cylinder. Additionally, the device interface 110*b* of the consolidated power tip 100*b* may comprise a center pin 160*b*. The center pin 160*b* may be a smart pin able to communicate power supply identification ("PSID") information or the like between the electronic device and the power adaptor. The power tip 100*b* may comprise a memory containing the PSID information and/or a resistor for providing the smart pin programming. Alternatively, the memory and/or resistor may be in the power adaptor and the adaptor interface may electrically couple the center pin 160*b* with the memory. In some embodiments, a user may be able to select whether to use the memory or the resistor to provide the smart pin programming. In other embodiments, the center pin 160*b* may act as the first electrical contact 140*b*, or a user may be able to select whether the center pin 160*b* or the inner surface of the cylinder acts as the first electrical contact 140*b*.

Figure 2D:
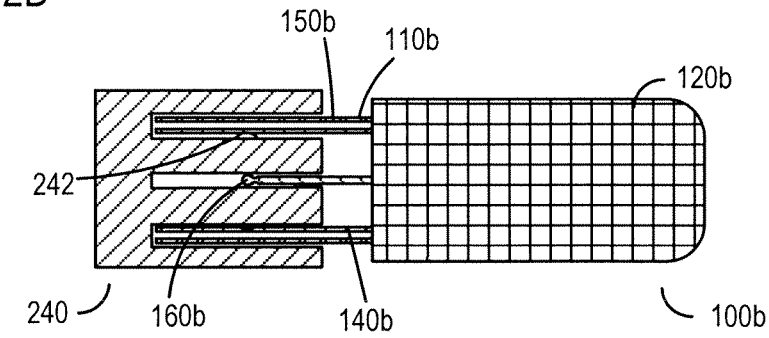
Figure 2E:
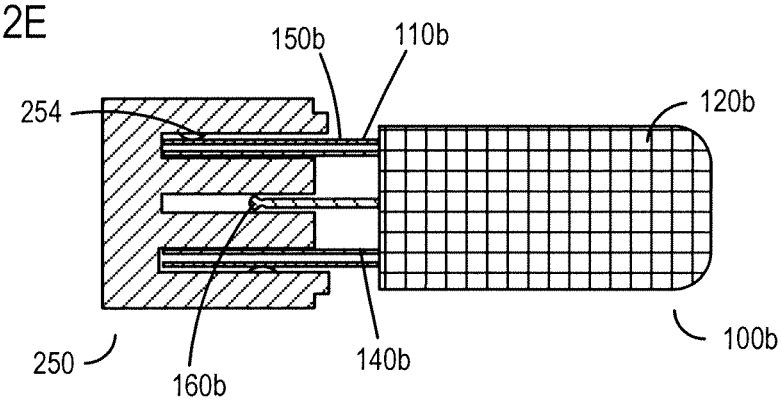

As shown in the cross-section views in FIGS. 2D and 2E, the consolidated power tip 100*b* may interface with input ports 240, 250 that have concentric cylindrical voids to interface with the consolidated power tip's 100*b* cylinder and pin 160*b*. Electrical contacts 242, 254 may be on the inner or outer surface of the cylindrical voids to couple with the device interface 110*b*. As before, the outer and inner circumferences of the cylinder are selected to ensure electrical contact with each desired input port 240, 250. The pin 160*b* is sized to ensure that it also makes electrical contact with each input port 240, 250 either as a first electrical contact or to communicate PSID information.

In the illustrated embodiment, the device interface 110*b* does not comprise arched strips. The insertion and pull resistance are instead controlled by varying the outer and inner circumference of the device interface 110*b*. Additionally, the circumference of the pin 160*b* may also be varied to alter the insertion or pull resistances of the various input ports 240, 250. In some embodiments, the desired input ports 240, 250 are sized and shaped, such that the outer circumference can be sized to create pull resistance above the required threshold for one input port while the inner circumference can be sized to create pull resistance above the required threshold for the another input port. The pin 160*b* might then be sized to create a threshold pull resistance with another input port.

In other cases, the outer cylindrical void of one input port may have both a larger outer circumference and smaller inner circumference than the other input port. This may prevent one input port from having a pull resistance above the necessary threshold without the other input port having an insertion resistance exceeding the allowable threshold. In these cases, the pin 160*b* may be sized large enough to create the desired pull resistance with the one input port while the outer and inner circumference are sized to create a greater than threshold pull resistance with the other input port. In some embodiments, arched strips may be added to the pin 160*b* to adjust the insertion and pull resistances as well.

Figure 2F:
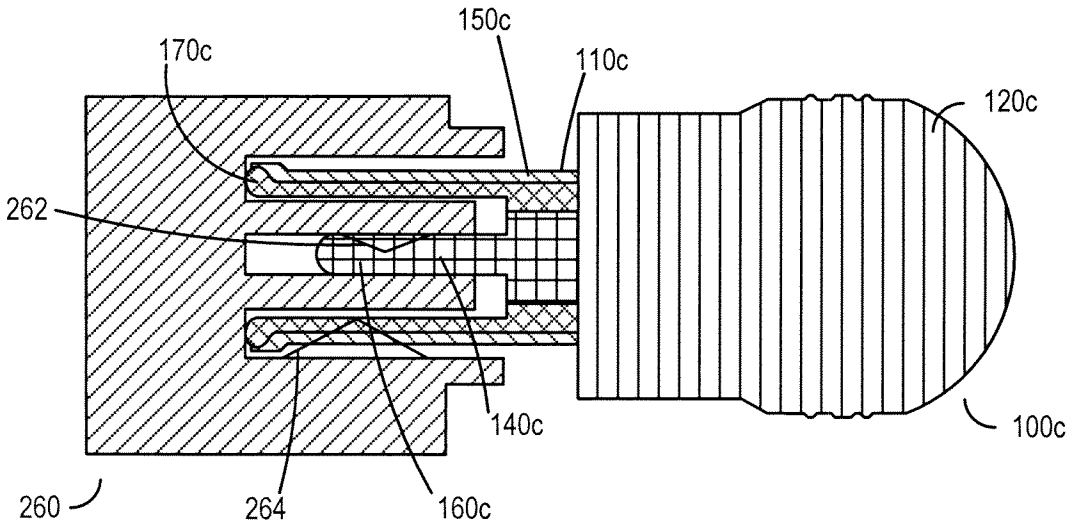

A third consolidated power tip 100*c* may comprise device interface 110*c* comprising a pin 160*c* with a first electrical contact 140*c* disposed on its surface. The device interface 110*c* may further comprise a cylinder with the second electrical contact 150*c* disposed on the outer surface of the cylinder but not the inner surface. An insulating section 170*c* may then insulate the electrical contact s 140*c*, 150*c* from direct electrical coupling. As shown in the cross-section view in FIG. 2F, the consolidated power tip 100*c* may interface with an input port 260 with electrical contacts 262, 264. The outer and inner circumferences of the cylinder and the circumference of the pin 160*c* may again be selected to ensure electrical contact with each desired input port 260 while maintaining acceptable insertion and pull resistances.

Consolidated Power Tips with Deformable Members

Figure 3A:
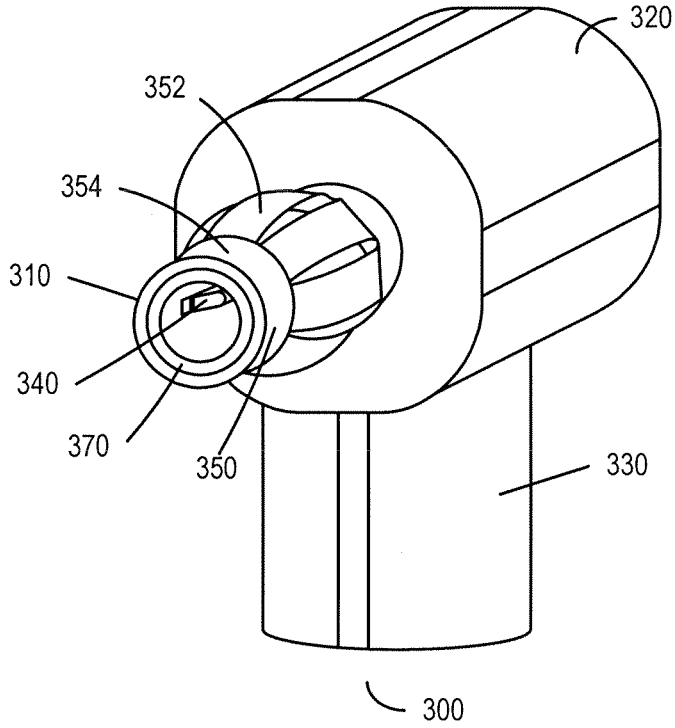
FIGS. 3A and B are a front angled view and a head-on view of an embodiment of a consolidated power tip with deformable members incorporated into the electrical contacts.
Figure 3B:
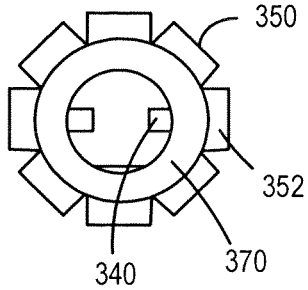

FIGS. 3A and 3B are a front angled view and a head-on view of a fourth consolidated power tip 300 with deformable members. Like the first consolidated power tip 100*a*, the consolidated power tip 300 may comprise a housing 320, a base 330, and a device interface 310 comprising a cylinder. A first electrical contact 340 may be disposed on the inner surface of the cylinder and a second electrical contact 350 may be disposed on the outer surface of the cylinder. The first and second electrical contacts 340, 350 may be separated by an insulating section 370. In the illustrated embodiment, the first electrical contact 340 comprises two deformable members. The deformable members are arched strips that run longitudinally along the internal surface of the cylinder. The second electrical contact 350 may comprise a plurality of deformable members 352 running longitudinally along the outer surface of the cylinder. The deformable members 352 on the outer surface may also be arch shaped with a height above the outer surface of the cylinder. The deformable members 352 may be made from metal or other metallic substances in some embodiments. A portion 354 of the second electrical contact 350 may not have any deformable members.

Figure 5A:
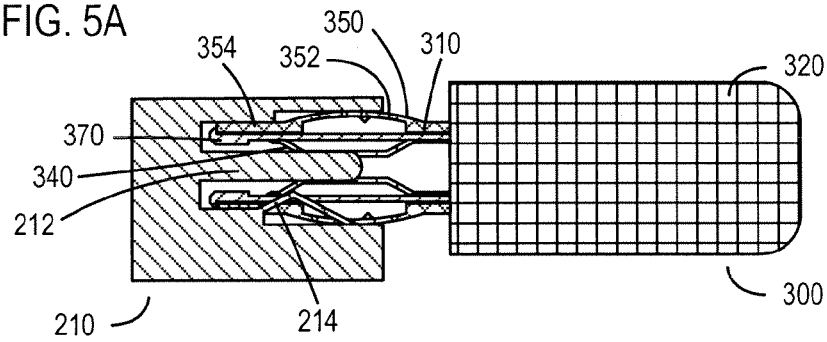
FIGS. 5A-E are cross-section views of consolidated power tips with deformable members interfacing with input ports of varying sizes.
Figure 5B:
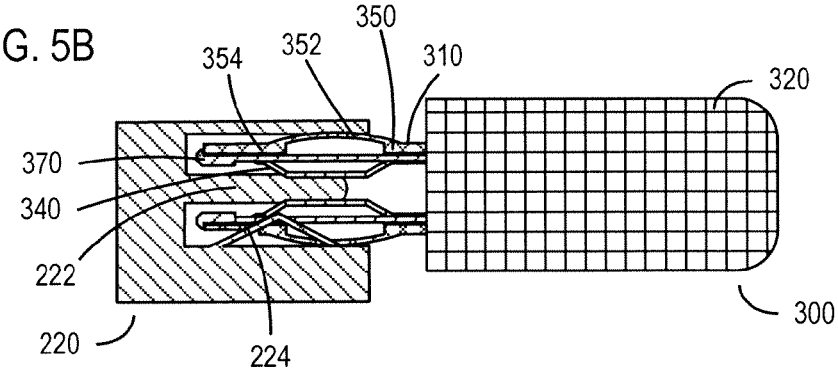
Figure 5C:
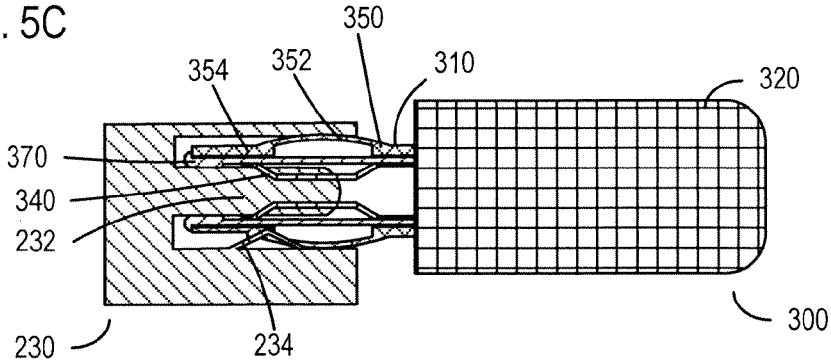

FIGS. 5A-C are cross-section views of the fourth consolidated power tip 300 interfacing with input ports 210, 220, 230 of varying sizes and design. The deformable members 352 are compressed by the input ports 210, 220, 230. As a result, the deformable members 352 exert a normal force against the sides of the input ports 210, 220, 230. This allows the power tip 300 to maintain acceptable insertion and pull resistances over a larger variance of input port sizes. Additionally, this may create a better electrical connection between the electrical contacts 340, 350 of the power tip 300 and the input port pins 212, 222, 232 and electrical contacts 214, 224, 234 of the input ports 210, 220, 230. The deformable member 352 may not run along the entire length of the cylinder in some embodiments. The deformable members 352 may be disposed proximally to the housing 320 and a conductive or insulating cylindrical section 354 may be disposed distally from the housing 320. This may cause the power tip 300 to exhibit preferable insertion and/or pull resistances for a wider set of variably sized input ports.

Figure 4A:
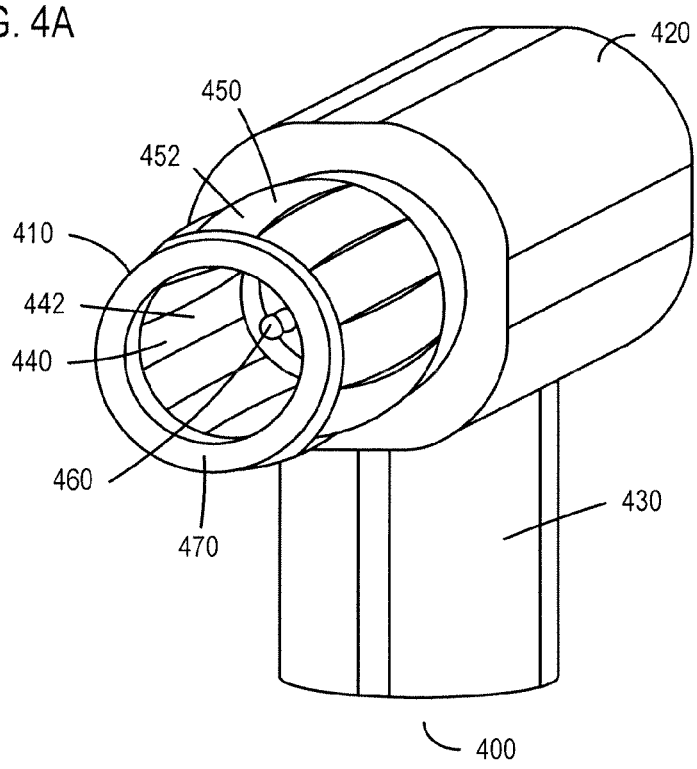
FIGS. 4A and B are a front angled view and a head-on view of another embodiment of a consolidated power tip with deformable members incorporated into the electrical contacts.
Figure 4B:
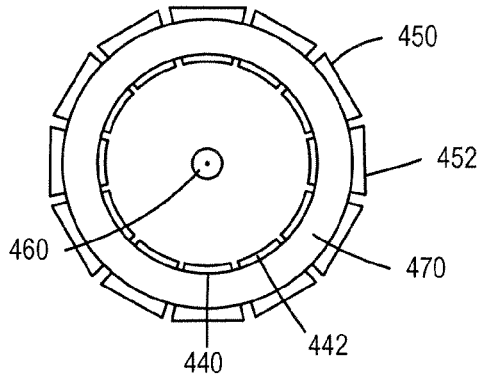

FIGS. 4A and 4B are a front angled view and a head-on view of a fifth consolidated power tip 400 with deformable members. Like the second consolidated power tip 100*b*, the device interface 410 of the consolidated power tip 400 may comprise a housing 420, a base 430, and a center pin 460. The device interface 410 may further comprise a cylinder with the first electrical contact 440 disposed on the inner surface of the cylinder. Alternatively, the first electrical contact may be disposed on the center pin 460, or a user may select between the inner surface of the cylinder 410 and the center pin 460 acting as the first electrical contact. The device interface 410 may comprise a second electrical contact 450 attached to the outer surface of the cylinder. The inner surface and outer surface of the cylinder may be separated by an insulator 470. The first electrical contact 440 disposed on the inner surface of the cylinder may comprise a plurality of deformable members 442. The second electrical contact 450 may also comprise a plurality of deformable members 452 on the outer surface of the cylinder. The deformable members 442, 452 may be arched strips of a conductive material and the center of the arch may be a chosen height above the outer surfaces of the cylinder. In alternate embodiments, the deformable members 442, 452 may be only on the outer surface or only on the inner surface of the cylinder. The pin 460 may also comprise deformable members in some embodiments.

Figure 5D:
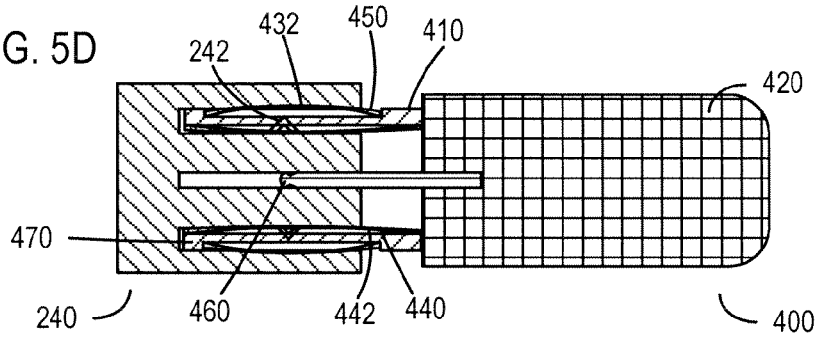
Figure 5E:
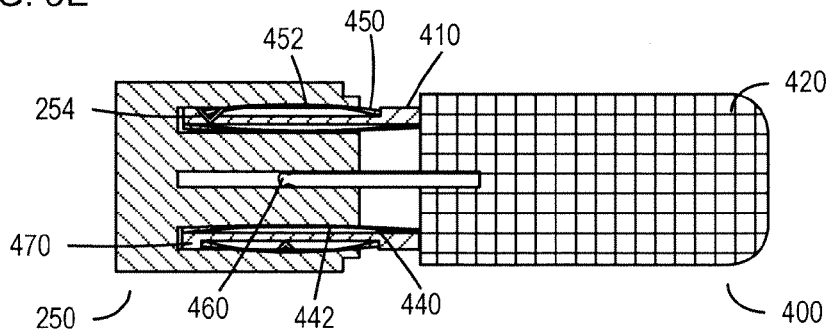

FIGS. 5D and 5E are cross-section views of the fifth consolidated power tip 400 interfacing with input ports requiring pins 240, 250. As with the fourth consolidated power tip 300, the consolidated power tip 400 may exhibit more desirable insertion and/or pull resistances over a wider range of input ports. Further, the deformable members 442, 452 may create a better electrical connection between the second electrical contact 450 of the power tip 400 and the electrical contacts 242, 254 of the input ports 240, 250.

Figure 6A:
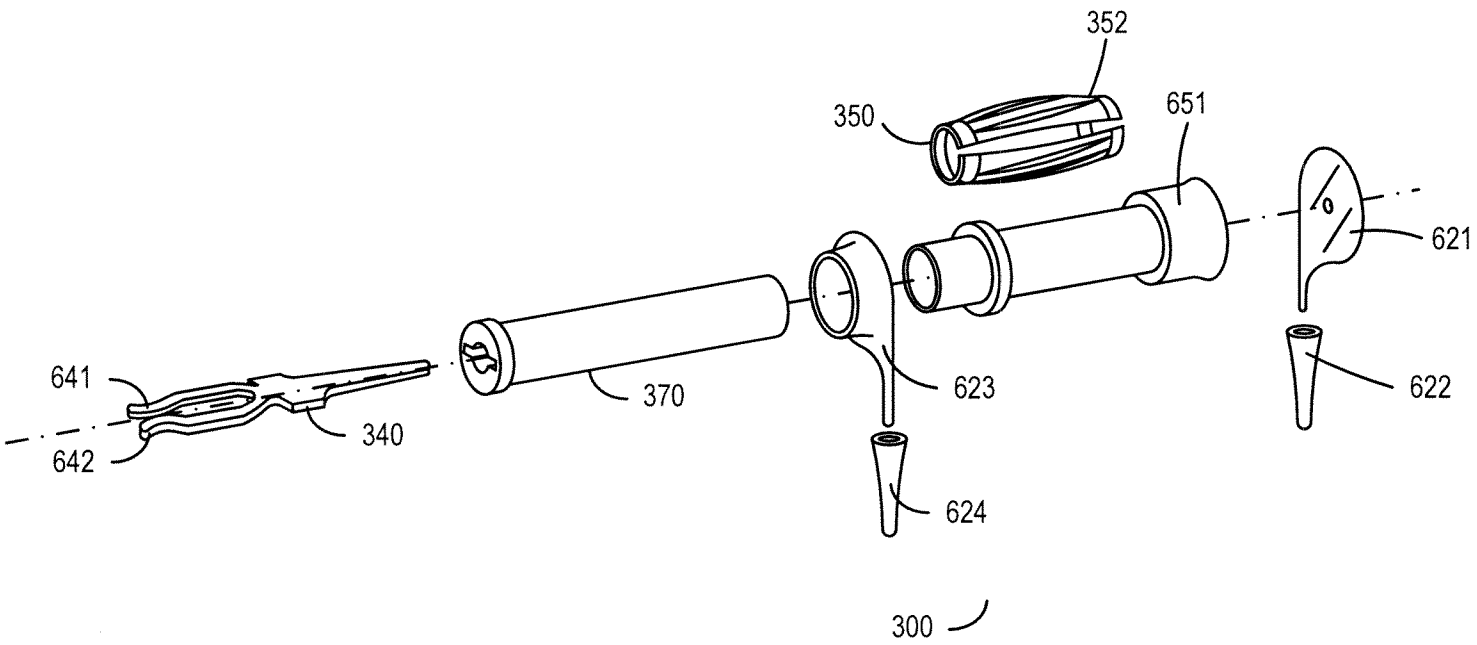
FIGS. 6A and B are expanded and interior views of an embodiment of a consolidated power tip with deformable members.

FIG. 6A is an expanded view of the fourth consolidated power tip 300. The first electrical contact 340 may be fabricated as a single piece, such as the pitchfork-shaped unit 340 illustrated. The prongs 641, 642 of the first electrical contact 340 may be bent towards one another at the distal end to create the arched contacts. The prongs 641, 642 may be substantially parallel at the proximal end to allow for more flex. The first electrical contact 340 may be housed by the cylindrical insulating section 370. The proximal end of the first electrical contact 340 may electrically couple with a first electrical intermediary 621, which may electrically couple with a first electrical pin 622. An outer cylinder 651 may house the cylindrical insulating section 370. The second electrical contact 350 may comprise the conductive deformable members 352 attached to an outer surface of the outer cylinder 651. In some embodiments, some or all of the outer cylinder may comprise a conductive surface. A second electrical intermediary 623 may surround the outer cylinder 651 and may be electrically coupled to the second electrical contact 350. The second electrical intermediary 623 may then be electrically coupled with a second electrical pin 624.

Figure 6B:
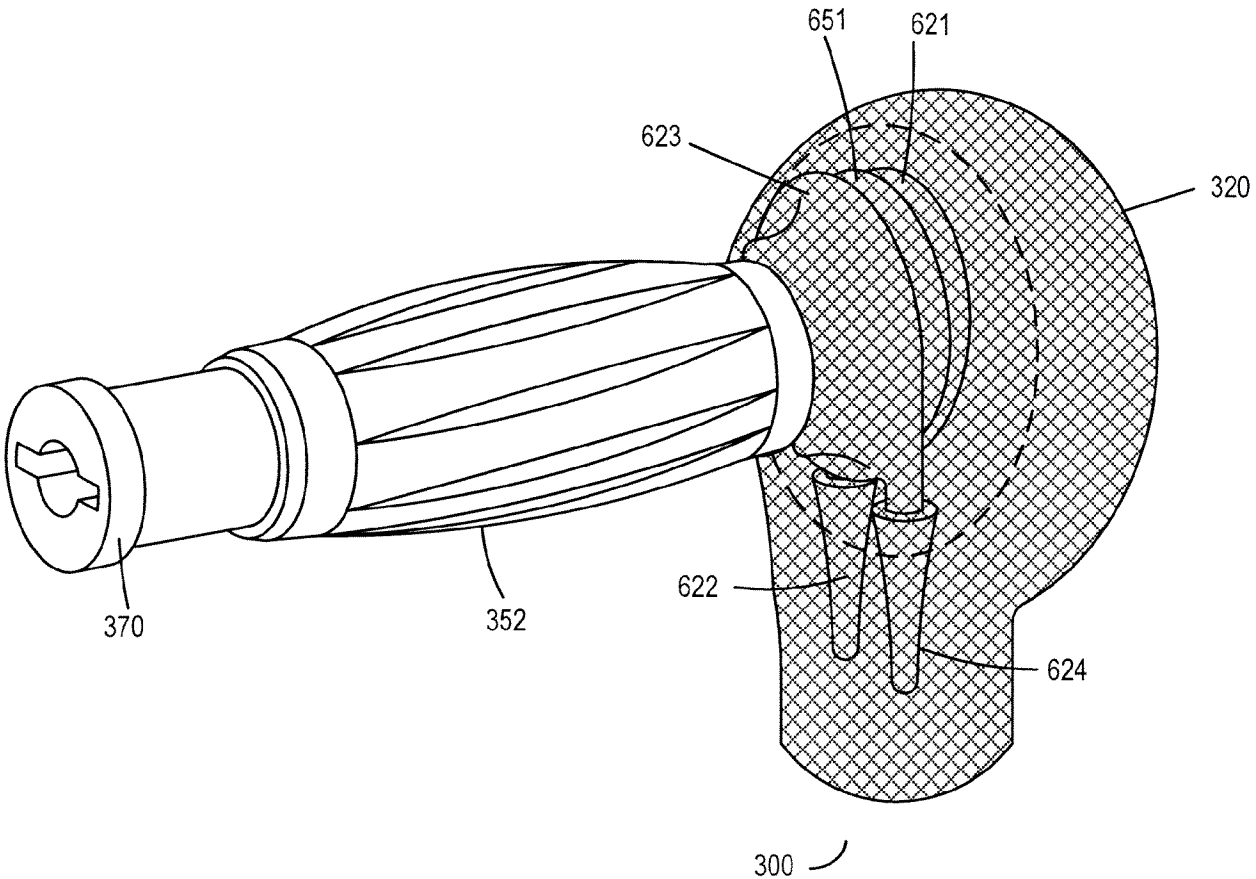

FIG. 6B is a view of the interior of the housing 320 for the assembled power tip 300. The electrical pins 622, 624 are exposed through the bottom of the base to allow for electrical coupling with an intermediate output connector from a power adaptor. In the illustrated embodiment, the outer cylinder 651 acts as an insulator preventing the first electrical intermediary and second electrical intermediary from directly electrically coupling.

Consolidated Power Tips with Selectable Output Mode

If a programmable power adaptor automatically determines electrical requirements based on the power tip connected to it, it may not be able to determine electrical requirements from a consolidated tip. Alternatively, a power tip may be designed to regulate the electrical power provided, such that it complies with electrical requirements of disparate electronic devices. Some consolidated power tips with a center pin may be designed to couple with input ports that use the center pin for different purposes, such as to act as a first electrical contact or to communicate PSID information. In any of these situations, a user may need to select different modes for the power tip based on the electrical requirements of different input ports. The consolidated power tip may comprise a mode selector to choose the appropriate output mode or the input port of interest.

Figure 7A:
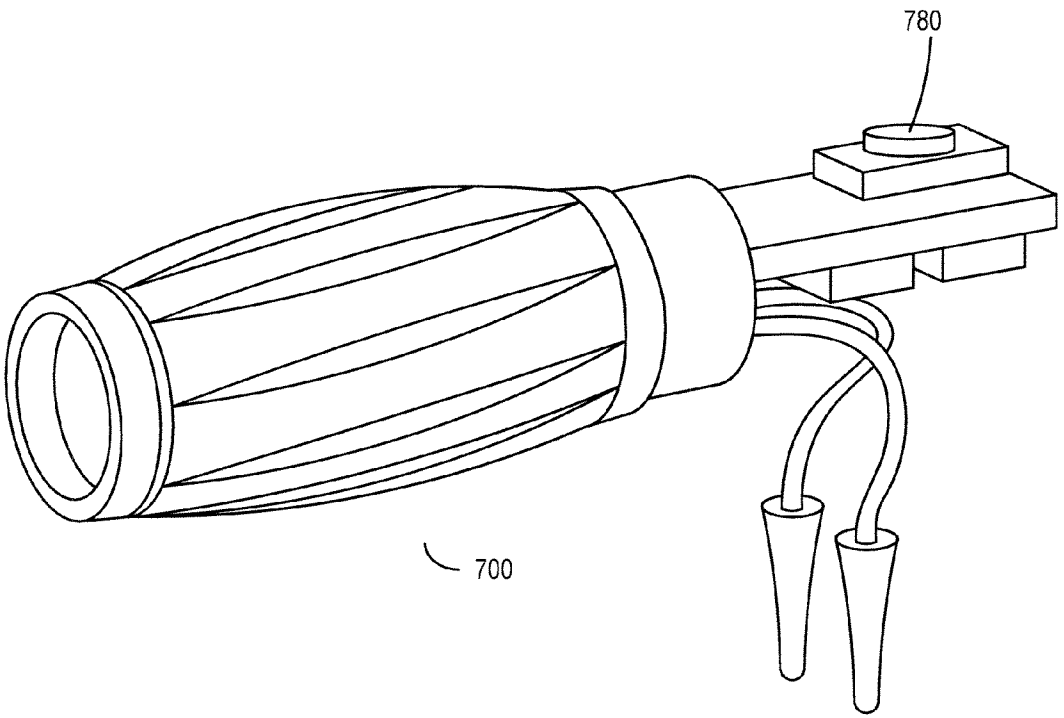
FIGS. 7A and B are interior and covered views of another embodiment of a consolidated power tip incorporating a tactile button to select the electrical configuration of the consolidated power tip.

FIG. 7A is an interior view of a consolidated power tip 700 with a tactile button 780. The tactile button 780 may be pushed to select different output modes for the consolidated power tip and/or power adaptor. Each output mode may cause the power output by the power tip and power adaptor to comply with the electrical requirements of a different electronic device. Alternatively or additionally, different output modes may comprise different smart pin programming, such as with a memory or with a resistor.

Figure 7B:
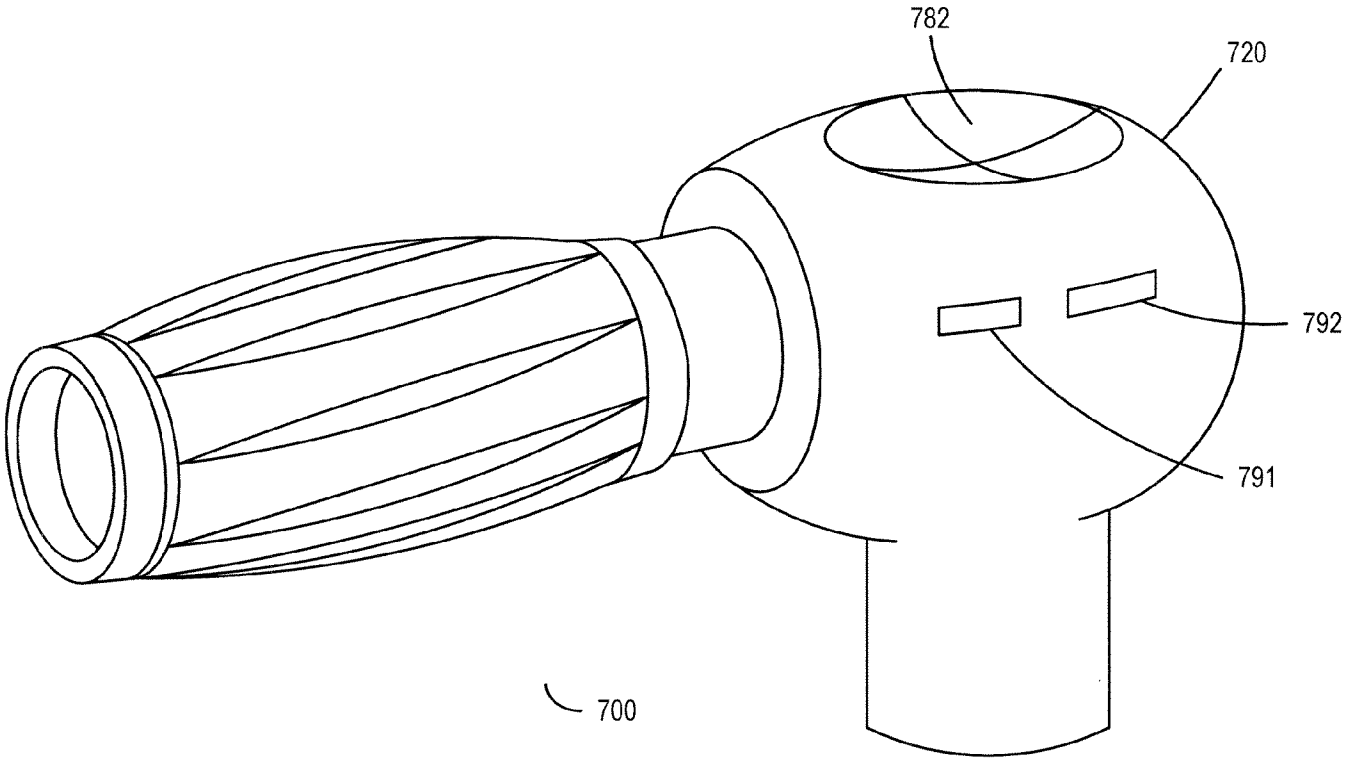

FIG. 7B shows a housing 720 for the consolidated power tip. In the illustrated embodiment, a flanged cover area 782 allows the tactile button (not shown) to be pushed through the housing 720. A pair of light-emitting diodes ("LEDs") 791, 792 may display the currently selected output mode through windows in the housing. In the illustrated embodiment, there are two output modes and each LED corresponds to an output mode. In this embodiment, one LED and only one LED is lit to indicate which mode the consolidated power tip is in. In alternate embodiments, there may be more than two output modes, more or less than two LEDs, alternative methods of lighting the LEDs to indicate the output mode, and/or a different type of indicator to communicate the mode to a user.

Figure 8A:
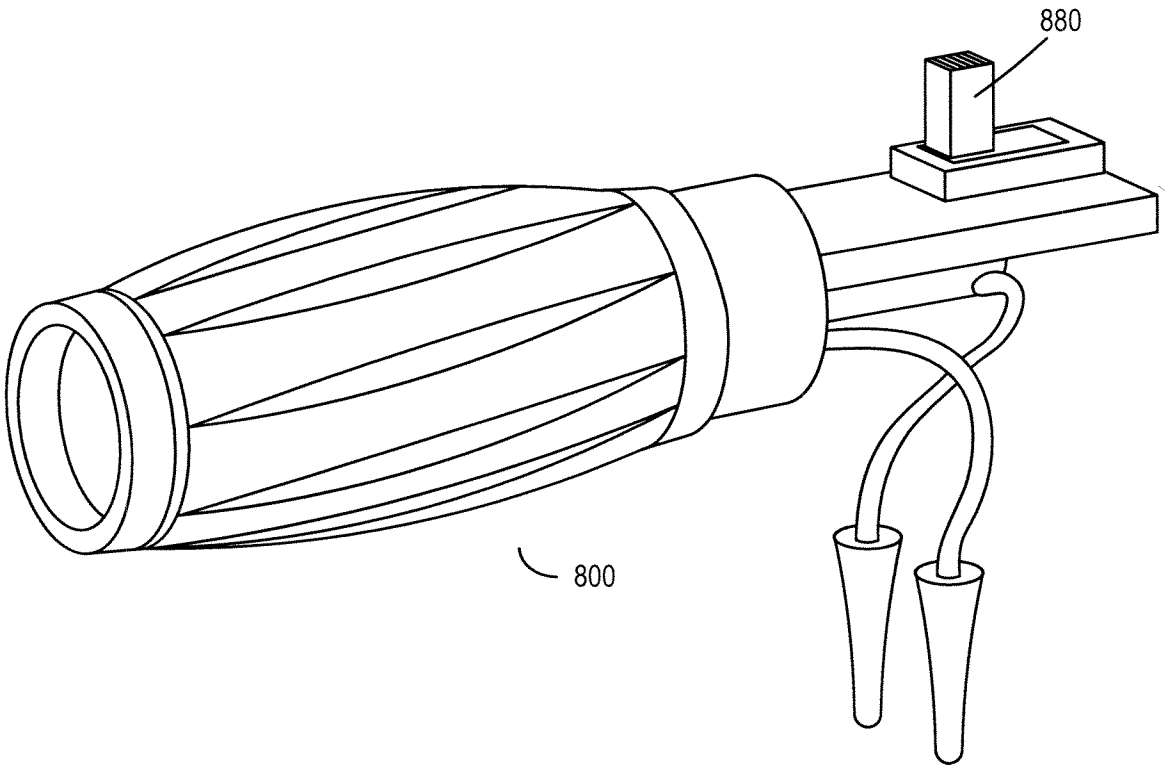
FIGS. 8A-C are interior, expanded, and covered views of alternate embodiments of consolidated power tips incorporating a switch to select the electrical configuration of the consolidated power tip.
Figure 8B:
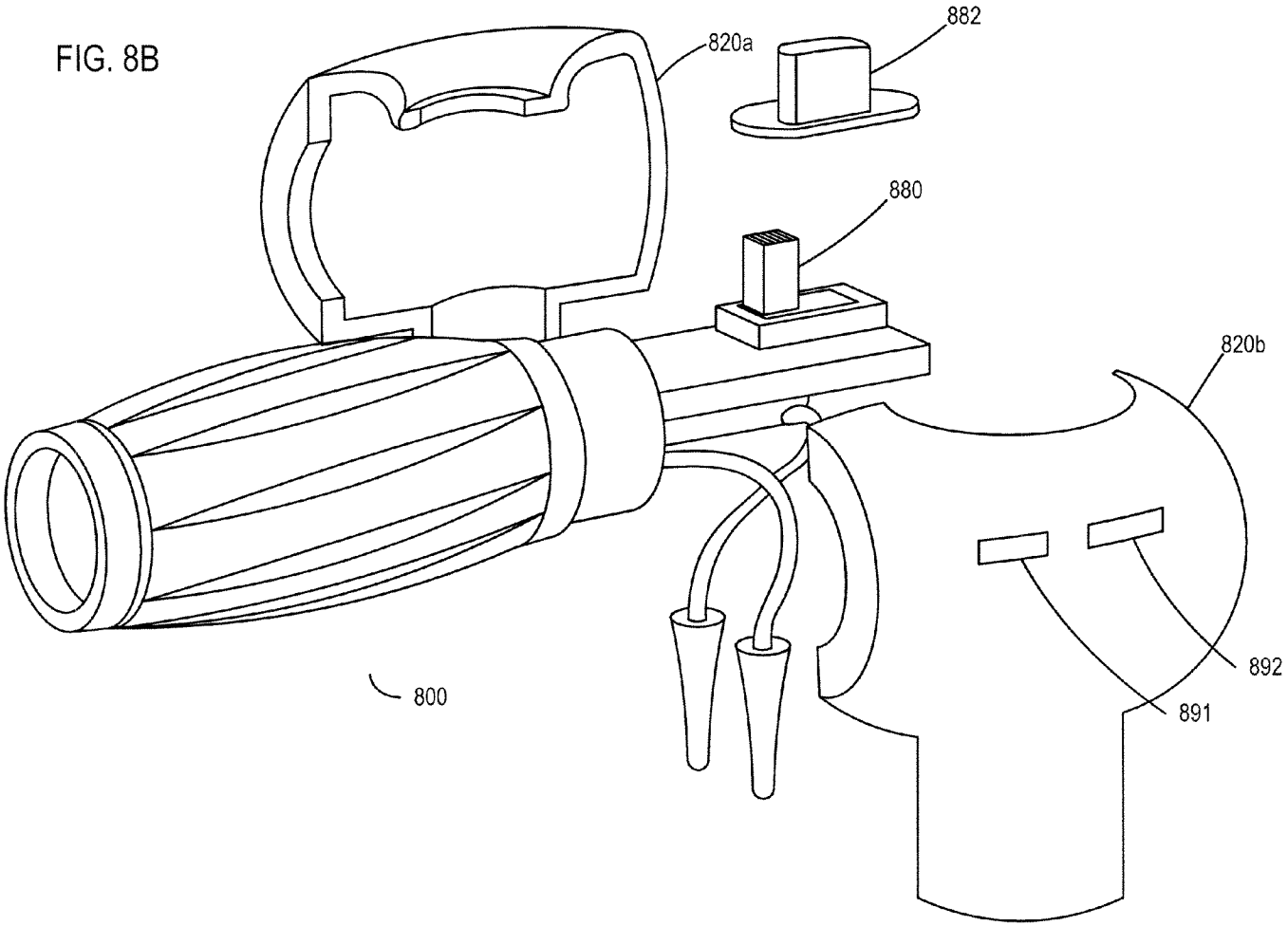
Figure 8C:
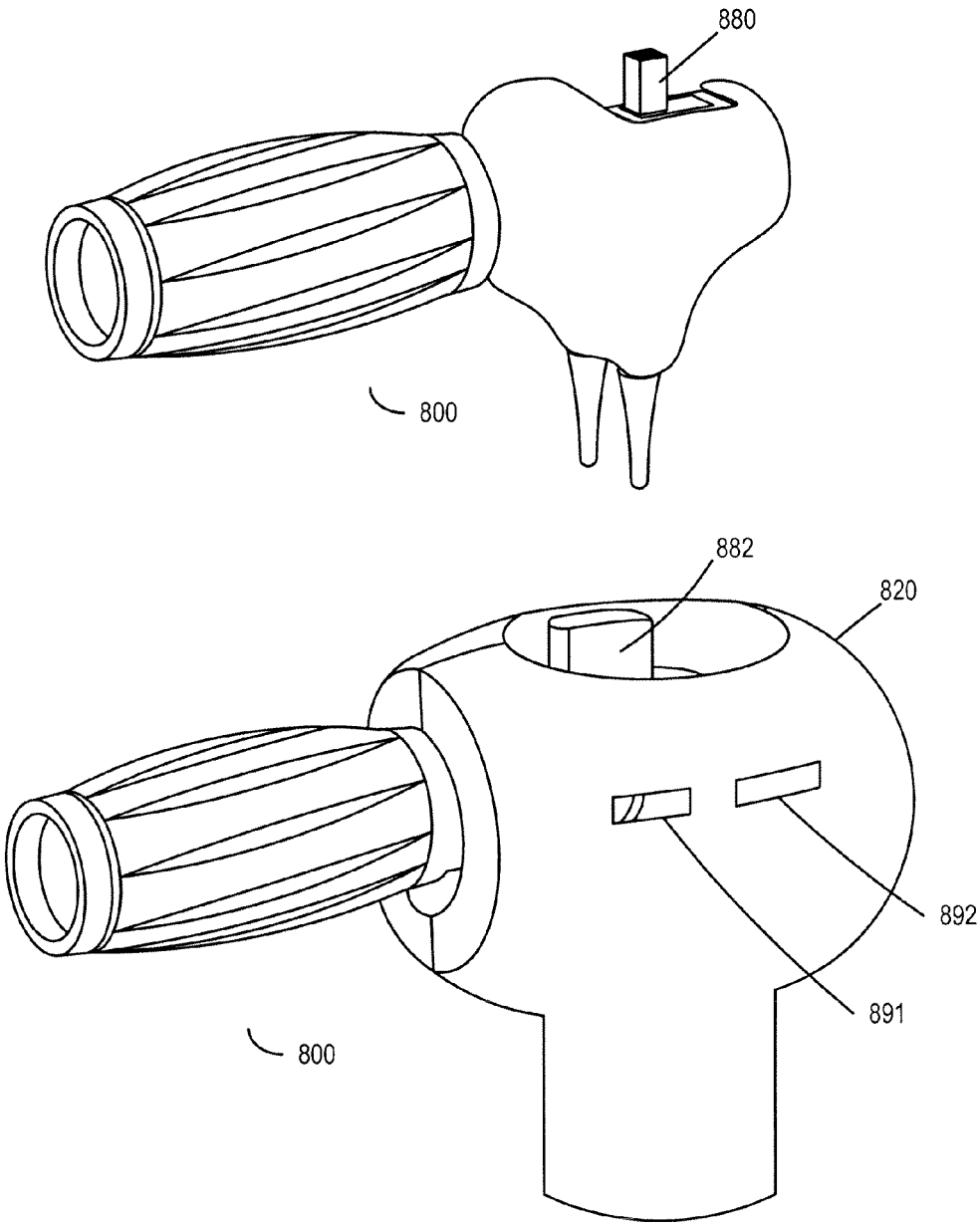

FIGS. 8A-C are interior, expanded, and covered views of another embodiment of a consolidated power tip 800 with a switch 880 for selecting output mode. A cover 882 made from a user friendly material, such as rubber or plastic, may house the switch. The illustrated switch 880 may select up to two different output modes. In other embodiments, a three-way switch or higher may be used to select more than two output modes. In some embodiments, the consolidated power tip 800 comprises LEDs 891, 892 to display the currently selected output mode. In other embodiments, labels on the housing 820 may indicate the output mode based on the position of the switch. FIG. 8B shows that the housing 820 may comprise two halves 820*a*, 820*b* that may be manufactured separately and combined during assembly of the power tip.

Manual Multi-Sleeve Power Tips

The consolidated power tips may be made even more convenient for users by combining the consolidated power tips into a single manual multi-sleeve power tip. The manual multi-sleeve power tip may comprise a plurality of device interfaces from many disparate power tip that share a common axis and are incorporated into a single housing. The manual multi-sleeve power tip may further comprise a mechanism for selecting a device interface of interest. In some embodiments, the manual multi-sleeve power tip may be removably coupled with the power adaptor via an intermediate output connector. In other embodiments, the manual multi-sleeve power tip is permanently coupled with the power adaptor. Users do not need to change power tips if the manual multi-sleeve power tip can couple with all devices of interest to the users. A permanently coupled manual multi-sleeve power tip able to interface with a large number of devices may also prevent users from losing power tips as may occur if the users have large numbers of individual power tips. Finally, it may simplify the power tip selection process by allowing users to quickly try each device interface.

Figure 9A:
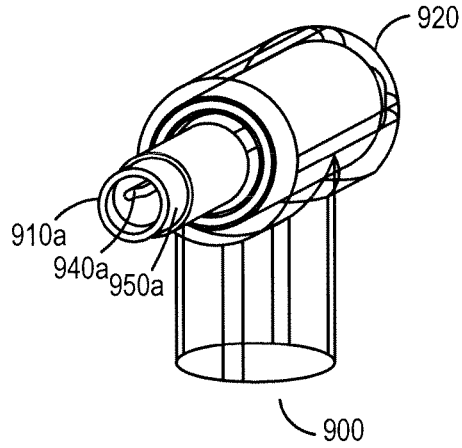
FIGS. 9A-C are front angled views of a manual multi-sleeve power tip with alternative sleeves extended.
Figure 9B:
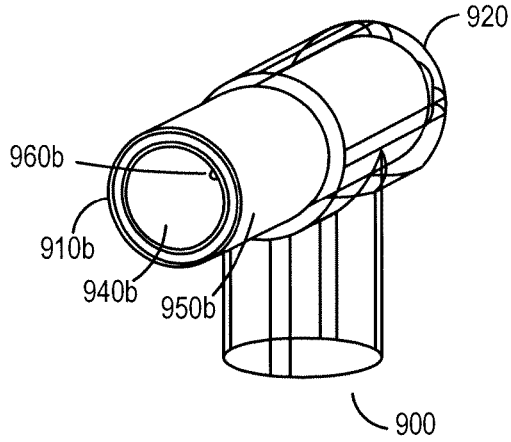
Figure 9C:
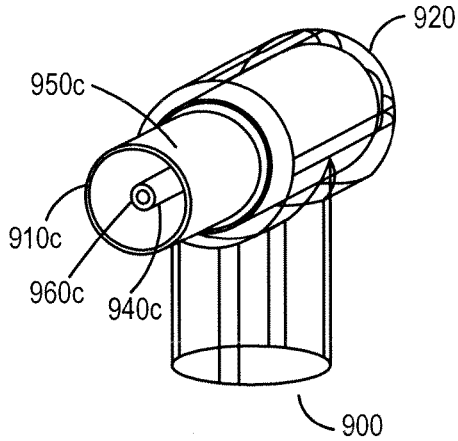
Figure 10A:
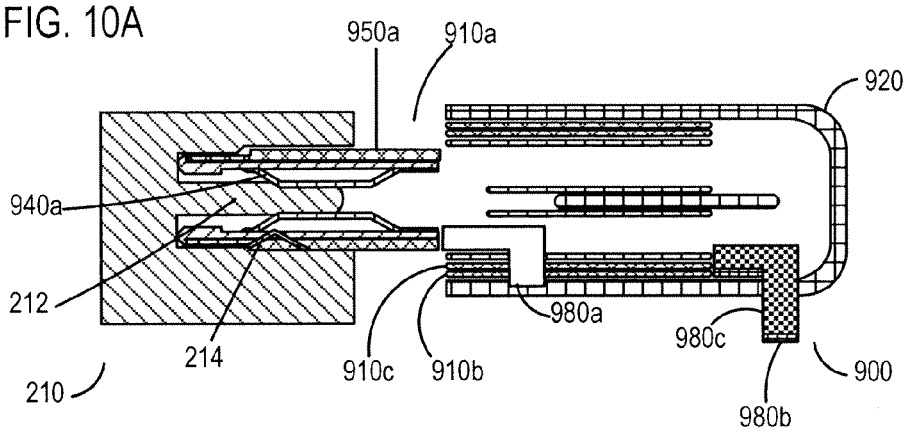
FIGS. 10A-F are cross-section views of the manual multi-sleeve power tip interfacing with input ports of varying sizes.
Figure 10B:
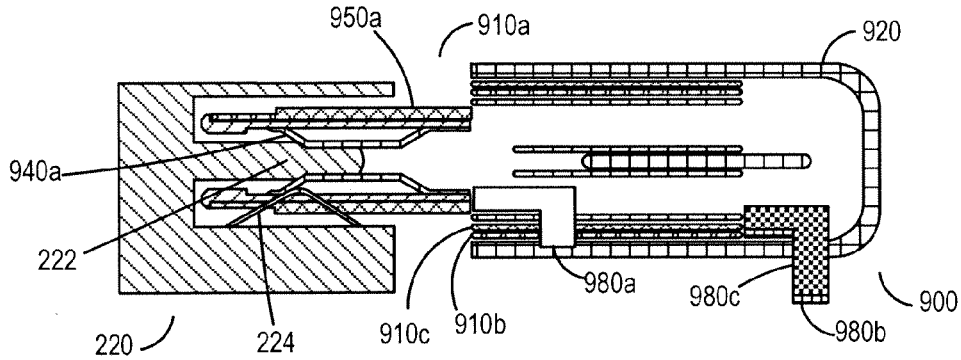
Figure 10C:
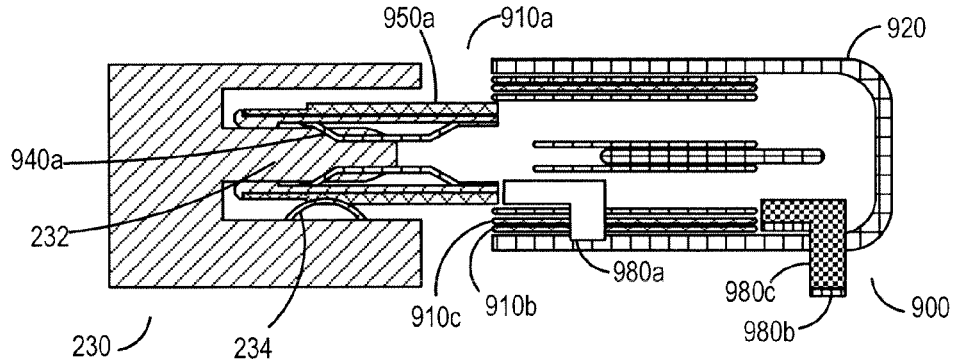
Figure 10D:
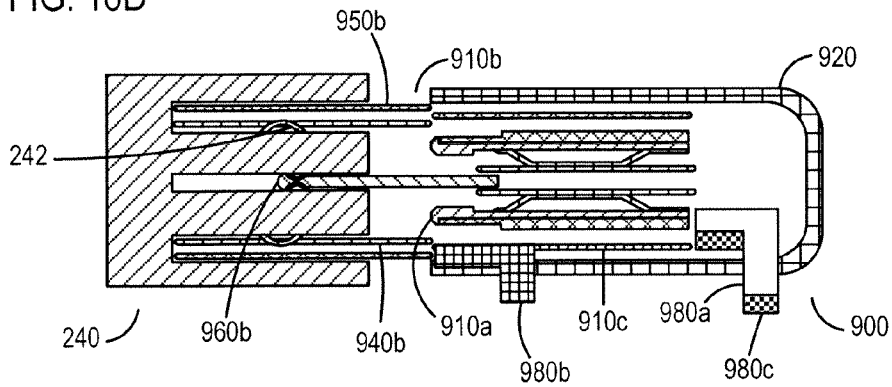
Figure 10E:
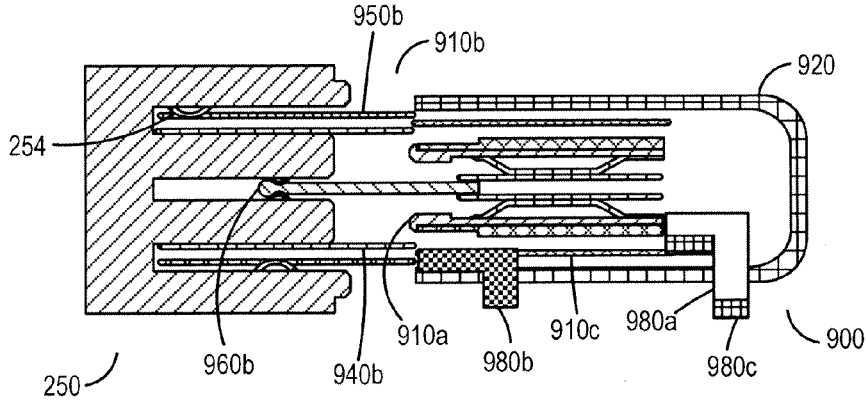
Figure 10F:
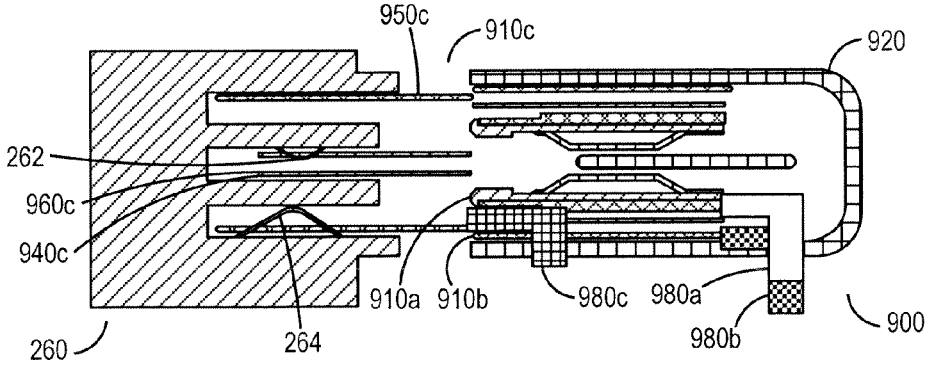

FIGS. 9A-C are front angled views of a manual multi-sleeve power tip 900 with alternative sleeves 910*a-c* extended. Each sleeve acts as a device interface for input ports of interest. The first device interface 910*a* is substantially similar to the device interface 110*a* of the first consolidated power tip 100*a*. Analogously, the second and third device interfaces 910*b*, 910*c* are substantially similar to the device interfaces 110*b*, 110*c* of the second and third consolidated power tips 100*b*, 100*c* respectively. As a result, the manual multi-sleeve power tip 900 is able to couple with any of the input ports that the consolidated power tips 110*a-c* could interface with. The device interfaces 910*a-c* share a common axis and extend from the same housing 920. In one of the illustrated embodiments, a first electrical contact 940*a* in the first device interface 910*a* comprises deformable members, but a second electrical contact 950*a* does not. In other embodiments, a different combination of electrical contacts 940*a-c*, 950*a-c* for the device interfaces 910*a-c* may comprise deformable members. The device interfaces 910*a-c* may also comprise pins 960*b*, 960*c*. Other embodiments may also have more or less than three device interfaces.

FIGS. 10A-F are cross-section views of the manual multi-sleeve power tip 900 interfacing with input ports 210, 220, 230, 240, 250, 260 of varying sizes. Each device interface 910*a-c* is affixed to a slidable tab 980*a-c*. The slidable tabs 980*a-c* extend through the housing 920 and allow a user to extend a particular device interface 910*a-c* manually while leaving the others retracted. Thus, the user can extend only the device interface 910*a-c* that interfaces with an input port of interest, or the user can quickly try every device interface 910*a-c* to determine which one is proper.

Automatic Multi-Sleeve Power Tips

Figure 11:
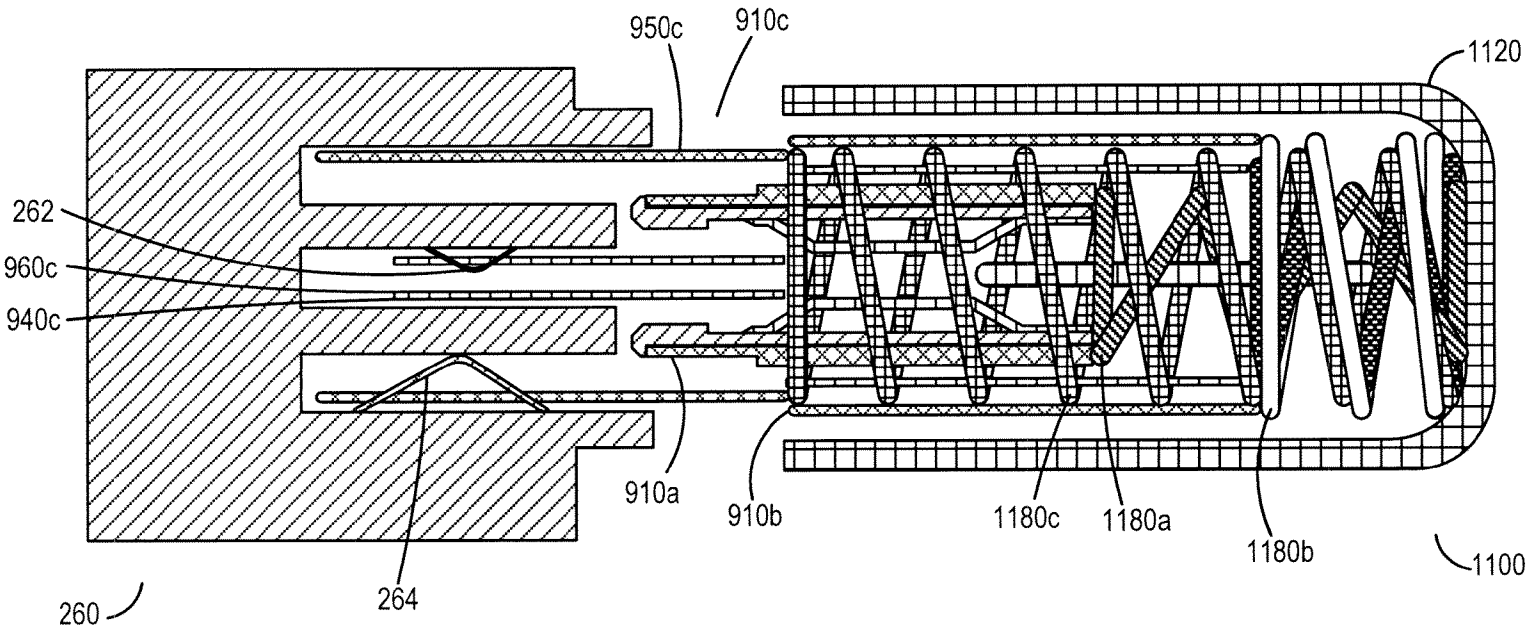
FIG. 11 is a cross-section view of an automatic multi-sleeve power tip interfacing with an input port.

FIG. 11 is a cross-section view of an automatic multi-sleeve power tip 1100 interfacing with an input port 260. In the illustrated embodiment, the manual extension mechanisms for extending the device interfaces 910*a-c* have been replaced by mechanical springs 1180*a-c*. In other embodiments, other extension mechanisms for extending the device interfaces 910*a-c* may be used, such as hydraulic or other springs, magnetic force, or the like. In some embodiments, all device interfaces 910*a-c* are pushed into an extended position when the automatic multi-sleeve power tip 1100 is not coupled with an input port. When the automatic multi-sleeve power tip 1100 is inserted into the input port 260, the unused device interfaces 910*a*, 910*b* are forced into a retracted position by the input port 260.

The springs 1180*a-c* each exert a spring force against the input port 260. When a user is inserting the automatic multi-sleeve power tip 1100, the insertion force applied by the user must overcome a frictional insertion resistance and the spring force of the unused device interfaces 910*a*, 910*b*. The spring force of the extended device interface 910*c* may be large enough to overcome the frictional insertion resistance. Additionally, the pull resistance will be the frictional pull resistance minus the spring force of the unused device interfaces 910*a*, 910*b*. If the spring force of the unused device interfaces 910*a*, 910*b* is larger than the frictional pull resistance, the automatic multi-sleeve power tip 1100 will eject itself from the input port 260.

In one embodiment, the springs 1180*a-c* and device interfaces 910*a-c* are selected such the spring force is never greater than the frictional pull resistance. In other embodiments, the automatic multi-sleeve power tip 1100 is designed such that the force exerted by the device interfaces 910*a-c* when extended is greater than the force exerted when the device interfaces 910*a-c* are retracted. For example, magnets exerting an attractive force against one another may be used to create the force to extend the device interfaces 910*a-c*. As the device interfaces 910*a-c* are retracted, the magnets would move away from one another, and the magnetic force would decrease with the inverse square of the distance.

Alternatively, one or more ratchets or locks may engage with stops on the device interfaces to prevent the device interfaces 910*a-c* from exerting any force when they are retracted. The ratchet or lock holds the device interfaces 910*a-c* in a fixed position and counteracts the spring force. A release mechanism may disengage the ratchet or lock by displacing it from the stops thereby allowing the spring force to extend the device interfaces 910*a-c*. The release mechanism may be connected to a user release interface, such as a button or lever, accessible on the surface of the housing 1120. The user release interface may have a safety or cover to prevent the release mechanism from being accidentally engaged. In some embodiments, a ratchet or lock may be used with the manual multi-sleeve power tip 900.

When inserting the automatic multi-sleeve power tip 1100 into an input port, the device interfaces 910*a-c* may all be extended initially. As the automatic multi-sleeve power tip 1100 is inserted into the input port 260, the unused device interfaces 910*a*, 910*b* are forced into a retracted position, and the lock or ratchet may force the unused device interfaces 910*a*, 910*b* to remain in the retracted position. Alternatively, a user may force all device interfaces 910*a-c* into such a fixed, retracted position to prevent damage to the device interfaces 910*a-c* when the automatic multi-sleeve power tip 1100 is not attached to the input port 260. Another method of inserting the automatic multi-sleeve power tip 1100 into the input port 260 would be to begin with all the device interfaces 910*a-c* in a fixed, retracted position. The automatic multi-sleeve power tip 1100 may be placed flush against the input, and the release mechanism may be triggered to cause the correct device interface 910*c* to extend into the input port 260. The automatic multi-sleeve power tip 1100 may be moved in an up-and-down motion, side-to-side motion, circular motion, or combination of the three motions to cause proper alignment of the desired device interface 910*c* with the input port 260. In some embodiments, the ratcheting or locking system may prevent more than one device interface 910*a-c* from being fully extended at any time.

Figure 12A:
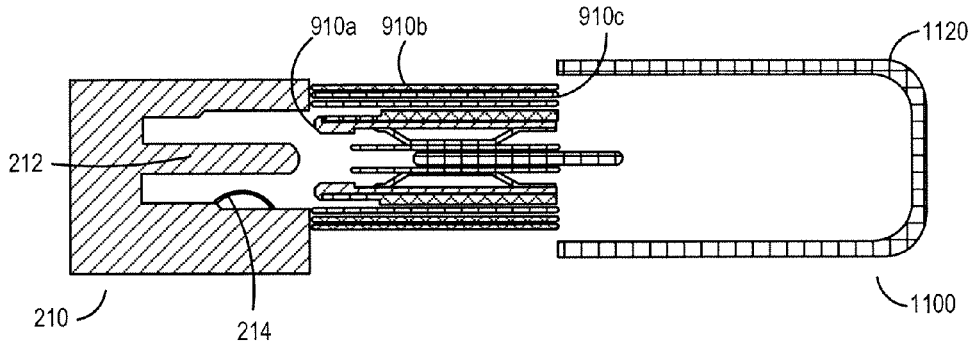
FIGS. 12A and B are cross-section views of the automatic multi-sleeve power tip as it interfaces with the input port from FIG. 2A.
Figure 12B:
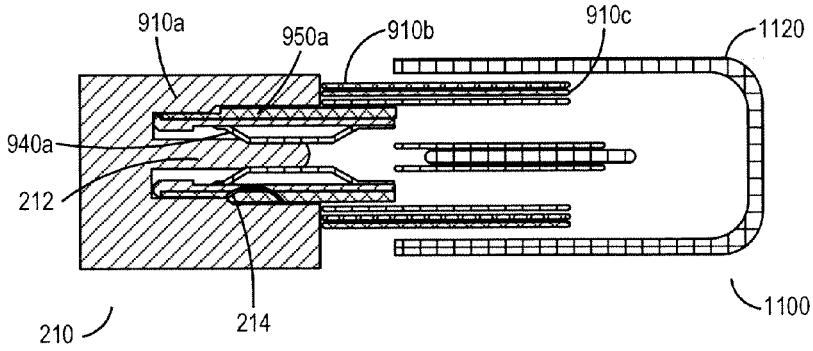
Figure 13A:
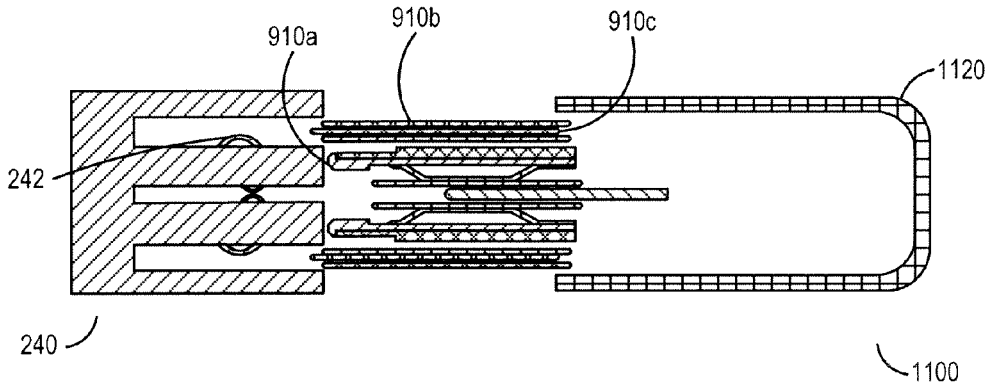
FIGS. 13A and B are cross-section views of the automatic multi-sleeve power tip as it interfaces with the input port from FIG. 2D.
Figure 13B:
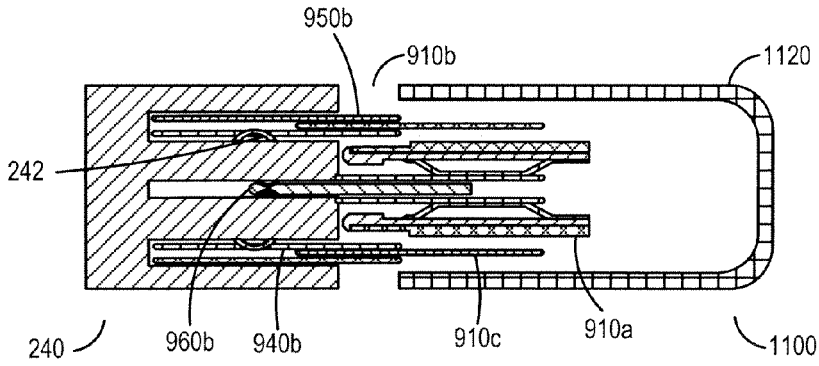

FIGS. 12A and B and 13A and B are cross-section views of the automatic multi-sleeve power tip 1100 as it interfaces with other input ports 210, 240. In the illustrated embodiment, the automatic multi-sleeve power tip 1100 does not have a ratcheting or locking system. As the multi-sleeve power tip 1100 is insert into the input ports 210, 240, the unused device interfaces 910*a-c* impact the walls and pins of the input ports 210, 240. The walls and pins of the input ports 210, 240 force the unused device interfaces 910*a-c* into a retracted position. Meanwhile, the correct device interface 910*a-c* does not impact the walls and pins of the input ports 210, 240 and is able to slide into the input port.

Figure 14A:
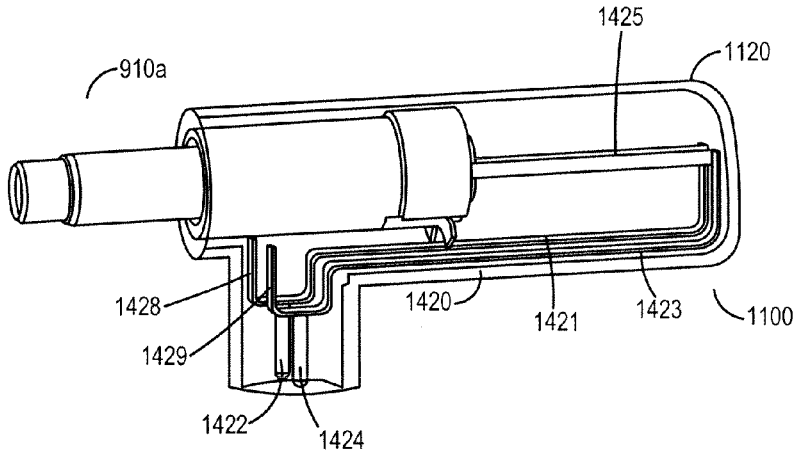
FIGS. 14A and B are side internal and top cross-section views of the automatic multi-sleeve power tip as it interfaces with the input port from FIG. 2A with internal electrical connections of the automatic multi-sleeve power tip shown.
Figure 14B:
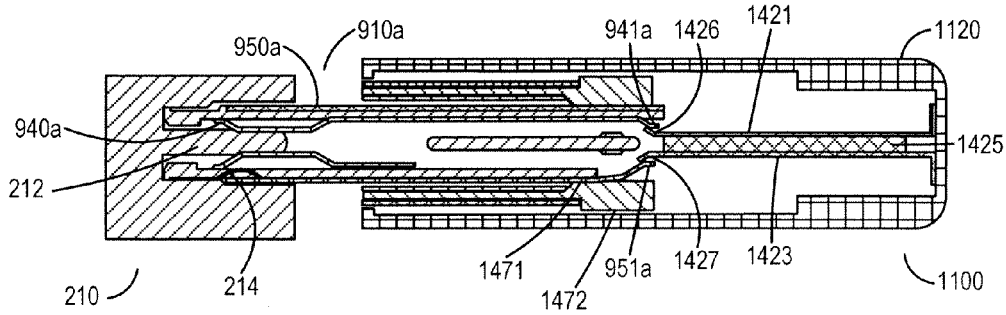

FIGS. 14A and B are side internal and top cross-section views of the automatic multi-sleeve power tip 1100 as it interfaces with the input port 210 with internal electrical connections of the automatic multi-sleeve power tip shown. The internal electrical connections illustrated may be used for the manual 900 or the automatic multi-sleeve power tips 1100. In the illustrated embodiment, an electrical intermediary 1420 connects the device interface 910*a* in use with pins 1422, 1424 that may interface with the power adaptor. In other embodiments, direct wiring to the power adaptor may replace the pins 1422, 1424. The pins 1422, 1424 may be connected to flat conductors 1421, 1423 that run the along the inside edge of the housing 1120 to the base of a fixed central column 1425. The flat conductors 1421, 1423 may run along the side of the fixed central column 1425. The flat conductors 1421, 1423 may then terminate in outwardly slanted tabs 1426, 1427. The flat conductors may also connect to front tabs 1428, 1429. When the device interface 910*a* is extended, tabs 941*a*, 951*a* on the device interface may come in contact with the outwardly slanted tabs 1426, 1427 thereby electrically coupling the device interface with the power adaptor. In some embodiments, it may be desirable to allow only the extended device interface 910*a* to couple with the power adaptor. As can be observed in FIG. 14B, oppositely polarized electrical contacts 950*a*, 940*b* may have little spacing between them and may couple if a lateral force is applied to the device interface 910*a* relative to the housing 1120, which would result in a short circuit if both contacts were powered. By only providing power to one device interface at a time, this problem is avoided.

In the illustrated embodiment, the flat conductors 1421, 1423 are offset 180 degrees from one another about the fixed central column 1425. There may be additional flat conductors 1421, 1423, or the flat conductors may be offset at other angles, such as 60, 72, 90, 120, or 150 degrees or the like, in other embodiments. The width of the flat conductors 1421, 1423 may also be quantified as an angle about the fixed central column 1425. For example, a flat conductor 1421, 1423 covering one third of the fixed central column 1425 would have an angle of 120 degrees. Possible angles for the width include 5, 10, 20, 30, 60, 90, or 120 degrees or the like. For example, each outwardly slanted tab 1426, 1427 may have a width of 100 to 120 degrees with a 180 degree offset. In such an embodiment, tabs 941*a*, 951*a* on a first device interface 910*a* may be offset from one another by 180 degrees. Tabs on a second device interface (not shown) may also be offset from one another by 180 degrees and offset by 90 degrees from the tabs 941*a*, 951*a* on the first device interface 910*a*. If the outwardly slanted tabs 1426, 1427 were properly positioned, this would allow either device interface to couple independently with the outwardly slanted tabs 1426, 1427 when that device interface was extended. More than two device interfaces may be capable of independently couple with the outwardly slanted tabs 1426, 1427 in some embodiments.

Bearing surfaces 1471, 1472 may be placed where the housing wall touches the device interface 910*b* or where one device interface 910*a* touches another device interface 910*b*. The contact between the housing 1120 and the device interfaces 910*a-c* may be used to provide additional stability and support for the device interfaces 910*a-c*. The bearing surfaces 1471, 1472 may be made from materials with a low coefficient of friction. In alternative embodiments, ball or roller bearings may be used instead of bearing surfaces 1471, 1472.

Figure 15A:
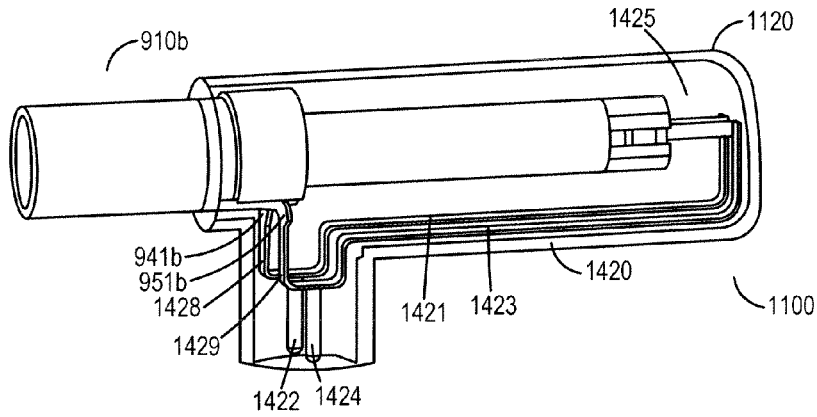
FIGS. 15A and B are side internal and side cross-section views of the automatic multi-sleeve power tip as it interfaces with the input port from FIG. 2D with internal electrical connections of the automatic multi-sleeve power tip shown.
Figure 15B:
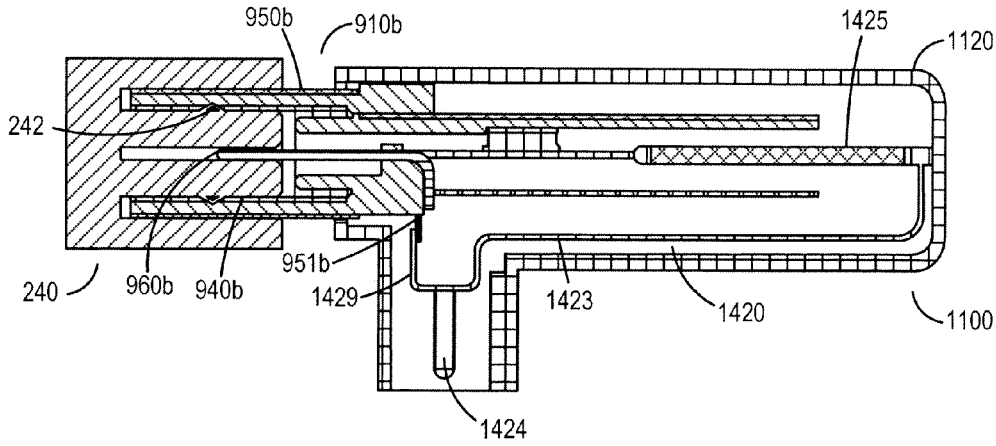

FIGS. 15A and B are side internal and side cross-section views of the automatic multi-sleeve power tip as it interfaces with the input port 240 with internal electrical connections of the automatic multi-sleeve power tip 1100 shown. Front tabs 1428, 1429 extending from the electrical intermediaries 1421, 1423 may contact tabs 941*b*, 951*b* on another device interface 910*b*. As before, in the illustrated embodiment, this device interface 910*b* is only coupled with the power adaptor when the device interface 910*b* is extended. This allows the device interface 910*b* to electrically couple with the power adaptor without needing to couple with the outwardly slanted tabs 1426, 1427 on the fixed column 1425.

In the illustrated embodiment, the center pin 960*b* for the extended device interface 910*b* is used to convey PSID information. The pin 960*b* may be curved to couple with the power adaptor and slide through a slit in the other device interfaces 910*a*, 910*c*. The slit may be the entire length of the device interfaces 910*a*, 910*c* or less than the entire length in some embodiments. In other embodiments, the pin 960*b* may interface with the power adaptor through a third contact on the fixed central column 1425. Alternatively, this contact may be disposed through the center of the fixed central column 1425.

It will be obvious to those having skill in the art that many changes may be made to the details of the above-described embodiments without departing from the underlying principles of the disclosure. The scope of the present disclosure should, therefore, be determined only by the following claims.

The invention claimed is:

1. A multi-sleeve power tip to couple electrically to a power adaptor and to couple alternatingly with variably sized input ports of electronic devices, the multi-sleeve power tip comprising:

a housing;

a first device interface having a first size and shape, the first device interface at least partially disposed within the housing and configured to electrically couple a power adaptor to a first input port of a first electronic device;

a first extension mechanism for extending and retracting the first device interface;

a second device interface having a second size and shape, the second device interface at least partially disposed within the housing and configured to electrically couple the power adaptor to a second input port of a second electronic device; and a second extension mechanism for extending and retracting the second device interface, wherein the second size and shape is different than the first size and shape, and wherein the first device interface and the second device interface share a common axis.

2. The multi-sleeve power tip of claim 1, wherein the first and second extension mechanisms comprise slidable tabs.

3. The multi-sleeve power tip of claim 1, wherein the first and second extension mechanisms comprise springs.

4. The multi-sleeve power tip of claim 1, wherein the first size and shape comprises a cylinder.

5. The multi-sleeve power tip of claim 1, wherein the second size and shape comprises a cylinder.

6. The multi-sleeve power tip of claim 1, wherein at least one of the first device interface and the second device interface comprises deformable members.

7. The multi-sleeve power tip of claim 6, wherein the first size and shape is configured to create a frictional engagement between the first device interface and a plurality of variably sized input ports of a corresponding plurality of electronic devices, wherein the frictional engagement of the first device interface with the plurality of variably sized input ports is configured to provide a threshold pull resistance, and wherein the frictional engagement of the first device interface with the plurality of variably sized input ports is further configured to provide less than a threshold insertion resistance.

8. The multi-sleeve power tip of claim 1, wherein the second device interface is disposed about the first device interface and is longitudinally displaceable relative to the first device interface.

9. The multi-sleeve power tip of claim 1, further comprising:

a first locking mechanism for locking the first device interface in a retracted position; and a second locking mechanism for locking the second device interface in a retracted position.

10. The multi-sleeve power tip of claim 9, further comprising a release mechanism to disengage the first and second locking mechanisms from the first and second device interfaces.

11. The multi-sleeve power tip of claim 1, further comprising a fixed column with outwardly slanted electrical contacts disposed thereon, wherein the outwardly slanted electrical contacts are positioned to electrically couple with the first device interface when the first device interface is in an extended position.

12. The multi-sleeve power tip of claim 11, wherein the outwardly slanted electrical contacts are disposed at an offset of 180 degrees about the fixed column relative to each other.

13. The multi-sleeve power tip of claim 1, further comprising front electrical contacts, wherein the front electrical contacts are positioned to electrically couple with the second device interface when the second device interface is in an extended position.

14. The multi-sleeve power tip of claim 1, further comprising:

a third device interface having a third size and shape, the third device interface at least partially disposed within the housing and configured to electrically couple the power adaptor to an input port of a third electronic device; and a third extension mechanism for extending and retracting the third device interface, wherein the third size and shape is different than the first size and shape and the second size and shape, and wherein the second device interface and the third device interface share a common axis.

15. A multi-sleeve power tip to couple electrically to a power adaptor and to couple alternatingly with variably sized input ports of electronic devices, the multi-sleeve power tip comprising:

a housing;

a first device interface at least partially disposed within the housing, the first device interface comprising:

a first electrical contact; and a second electrical contact, wherein a first size and shape of the first and second electrical contacts is configured to electrically couple a power adaptor to a first input port of a first electronic device;

a first extension mechanism for extending and retracting the first device interface;

a second device interface at least partially disposed within the housing, the second device interface comprising:

a first electrical contact; and a second electrical contact, wherein a second size and shape of the first and second electrical contacts is configured to electrically couple the power adaptor to a second input port of a second electronic device, wherein the second size and shape is different than the first size and shape, and wherein at least one of the first electrical contact or the second electrical contact shares a common axis with the first device interface; and a second extension mechanism for extending and retracting the second device interface.

16. The multi-sleeve power tip of claim 15, wherein the first and second extension mechanisms comprise slidable tabs.

17. The multi-sleeve power tip of claim 15, wherein the first and second extension mechanisms comprise springs.

18. The multi-sleeve power tip of claim 15, wherein the first size and shape comprises a cylinder.

19. The multi-sleeve power tip of claim 15, wherein the second size and shape comprises a cylinder.

20. The multi-sleeve power tip of claim 15, wherein at least one of the first device interface and the second device interface comprises deformable members.

21. The multi-sleeve power tip of claim 20, wherein the second size and shape is configured to create a frictional engagement between the second device interface and a plurality of variably sized input ports of a corresponding plurality of electronic devices, wherein the frictional engagement of the second device interface with the plurality of variably sized input ports is configured to provide a threshold pull resistance, and wherein the frictional engagement of the second device interface with the plurality of variably sized input ports is further configured to provide less than a threshold insertion resistance.

22. The multi-sleeve power tip of claim 15, wherein at least one of the first electrical contact and the second electrical contact is disposed about the first device interface and is longitudinally displaceable relative to the first device interface.

23. The multi-sleeve power tip of claim 15, further comprising:

a first locking mechanism for locking the first device interface in a retracted position; and a second locking mechanism for locking the second device interface in a retracted position.

24. The multi-sleeve power tip of claim 23, further comprising a release mechanism to disengage the first and second locking mechanisms from the first and second device interfaces.

25. The multi-sleeve power tip of claim 15, further comprising a fixed column with outwardly slanted electrical contacts disposed thereon, wherein the outwardly slanted electrical contacts are positioned to electrically couple with the first device interface when the first device interface is in an extended position.

26. The multi-sleeve power tip of claim 25, wherein the outwardly slanted electrical contacts are disposed at an offset of 180 degrees about the fixed column relative to each other.

27. The multi-sleeve power tip of claim 15, further comprising a first front electrical contact and a second front electrical contact, wherein the first and second front electrical contacts are positioned to electrically couple with the first and second electrical contacts respectively when the second device interface is in an extended position.

28. A multi-sleeve power tip to couple electrically to a power adaptor and to couple alternatingly with variably sized input ports of electronic devices, the multi-sleeve power tip comprising:

a housing;

a first device interface at least partially disposed within the housing, the first device interface comprising:

a first electrical contact; and a second electrical contact, wherein a first size and shape of the first and second electrical contacts is configured to electrically couple a power adaptor to an input port of a first electronic device;

a first extension mechanism for extending the first device interface;

a second device interface at least partially disposed within the housing, the second device interface comprising:

a first electrical contact; and a second electrical contact, wherein a second size and shape of the first and second electrical contacts is configured to electrically couple the power adaptor to a second input port of a second electronic device, wherein the second electrical contact is cylindrical, and wherein the second electrical contact is disposed about the first device interface and is longitudinally displaceable relative to the first device interface.

29. A multi-sleeve power tip to couple electrically to a power adaptor and to couple alternatingly with variably sized input ports of electronic devices, the multi-sleeve power tip comprising:

a housing;

a first sleeve having a first size and shape, the first sleeve at least partially disposed within the housing and configured to electrically couple a power adaptor to a first input port of a first electronic device;

a first extension mechanism for extending and retracting the first sleeve;

a second sleeve having a second size and shape, the second sleeve at least partially disposed within the housing and configured to electrically couple the power adaptor to a second input port of a second electronic device; and a second extension mechanism for extending and retracting the second sleeve, wherein the second size and shape is different than the first size and shape, and wherein the first sleeve and the second sleeve share a common axis.

* * * * *